US008344885B2

(12) United States Patent
Smith

(10) Patent No.: US 8,344,885 B2
(45) Date of Patent: Jan. 1, 2013

(54) CONTAINER WITH INTERIOR ENCLOSURE OF COMPOSITE MATERIAL HAVING EMBEDDED SECURITY ELEMENT

(75) Inventor: Fred Hewitt Smith, Orono, ME (US)

(73) Assignee: Angel Secure Networks Inc., Orono, ME (US)

( * ) Notice: Subject to any disclaimer, the term of this patent is extended or adjusted under 35 U.S.C. 154(b) by 502 days.

(21) Appl. No.: 12/358,132

(22) Filed: Jan. 22, 2009

(65) Prior Publication Data

US 2010/0018964 A1 Jan. 28, 2010

Related U.S. Application Data

(60) Provisional application No. 61/022,727, filed on Jan. 22, 2008, provisional application No. 61/055,109, filed on May 21, 2008.

(51) Int. Cl.
*G08B 13/00* (2006.01)

(52) U.S. Cl. ..... 340/550; 340/552; 340/555; 340/556; 340/557; 340/5.61; 340/568.2; 340/10.1; 713/153; 713/168; 713/170; 713/182; 713/186; 726/23; 726/27; 726/28; 726/29

(58) Field of Classification Search ..... 340/550, 340/552, 555, 556, 557, 5.61, 10.1, 568.2; 713/153, 168, 170, 182, 186; 726/23, 27, 726/28, 29
See application file for complete search history.

(56) References Cited

U.S. PATENT DOCUMENTS

| | | | |
|---|---|---|---|
| 3,779,448 | A | 12/1973 | Wootten |
| 3,974,934 | A | 8/1976 | Rohner |
| 4,765,512 | A | 8/1988 | Bull |
| 4,829,549 | A | 5/1989 | Vogel |
| 4,972,175 | A | 11/1990 | MacPherson |
| 5,289,785 | A | 3/1994 | MacPherson |
| 5,299,273 | A | 3/1994 | Evans |
| 5,455,926 | A | 10/1995 | Keele |
| 5,461,385 | A | 10/1995 | Armstrong |
| 5,524,133 | A | 6/1996 | Neale |
| 5,538,178 | A | 7/1996 | Zink |
| 5,539,379 | A | 7/1996 | MacPherson |
| 5,601,202 | A | 2/1997 | Meacham |
| 5,642,394 | A | 6/1997 | Rothschild |

(Continued)

FOREIGN PATENT DOCUMENTS

GB 2098770 11/1982

(Continued)

OTHER PUBLICATIONS

"Video located on the web page of Tamper Proof Container Systems Corporation", www.tamperproofcontainersystems.com (see link entitled "View TPCS Presentation"); accessed Nov. 15, 2009.

*Primary Examiner* — Tai T Nguyen
(74) *Attorney, Agent, or Firm* — Guntin Meles & Gust, PLC; Ralph Trementozzi

(57) ABSTRACT

An apparatus is disclosed including one or more security structures. The one or more security structures includes: a weldable frame; a plurality of composite panels, each panel securable to the weldable frame, each composite panel configured to form at least one joint with at least one adjoining composite panel; and a respective security element embedded within each of the composite panels. The security element is configured to detect a breach in the composite panel.

20 Claims, 23 Drawing Sheets

U.S. PATENT DOCUMENTS

| | | | | |
|---|---|---|---|---|
| 5,656,996 | A | 8/1997 | Houser | |
| 5,959,568 | A | 9/1999 | Woolley | |
| 5,979,684 | A * | 11/1999 | Ohnishi et al. | 220/1.5 |
| 6,995,353 | B2 | 2/2006 | Beinhocker | |
| 6,995,669 | B2 | 2/2006 | Morales | |
| 7,019,640 | B2 | 3/2006 | Canich | |
| 7,019,683 | B2 | 3/2006 | Stevens | |
| 7,030,411 | B2 | 4/2006 | Krulevitch | |
| 7,098,444 | B2 | 8/2006 | Beinhocker | |
| 7,162,007 | B2 | 1/2007 | Elvan | |
| 7,165,484 | B2 | 1/2007 | WanQ | |
| 7,176,793 | B1 | 2/2007 | Hummer | |
| 7,180,418 | B1 | 2/2007 | Willms | |
| 7,181,312 | B2 | 2/2007 | Takehara | |
| 7,188,513 | B2 | 3/2007 | Wilson | |
| 7,190,265 | B1 | 3/2007 | Bohine | |
| 7,191,942 | B2 | 3/2007 | Aotekar | |
| 7,211,783 | B2 | 5/2007 | Beinhhocker | |
| 7,271,723 | B2 | 9/2007 | Ando | |
| 7,283,052 | B2 * | 10/2007 | Bohman et al. | 340/572.1 |
| 7,332,728 | B2 | 2/2008 | Beinhocker | |
| 7,334,697 | B2 * | 2/2008 | Myers et al. | 220/1.5 |
| 7,394,060 | B2 | 7/2008 | Beinhocker | |
| 7,428,924 | B2 | 9/2008 | Patel | |
| 7,576,653 | B2 | 8/2009 | Smith | |
| 7,608,812 | B2 * | 10/2009 | Beinhocker | 250/227.14 |
| 2001/0035410 | A1 | 11/2001 | Taube | |
| 2003/0075608 | A1 | 4/2003 | Atherton | |
| 2003/0173408 | A1 | 9/2003 | Mosher | |
| 2004/0046660 | A1 | 3/2004 | Ando | |
| 2004/0220753 | A1 | 11/2004 | Tabe | |
| 2005/0073406 | A1 | 4/2005 | Easley | |
| 2005/0177271 | A1 | 8/2005 | Koren | |
| 2005/0184871 | A1 | 8/2005 | Coste | |
| 2005/0225432 | A1 | 10/2005 | Lindskog | |
| 2005/0275537 | A1 | 12/2005 | Kerr | |
| 2006/0023835 | A1 | 2/2006 | Seppi | |
| 2006/0103520 | A1 | 5/2006 | Clark | |
| 2006/0164239 | A1 | 7/2006 | Loda | |
| 2006/0285440 | A1 | 12/2006 | Dagher | |
| 2007/0001844 | A1 | 1/2007 | Krill | |
| 2007/0003003 | A1 | 1/2007 | Seppietal | |
| 2007/0039954 | A1 | 2/2007 | Wang | |
| 2007/0229285 | A1 | 10/2007 | Smith | |
| 2008/0211669 | A1 | 9/2008 | Dagher | |
| 2008/0237485 | A1 | 10/2008 | Beinhocker | |
| 2009/0115607 | A1 | 5/2009 | Beinhocker | |
| 2010/0201519 | A1 | 8/2010 | Dagher | |
| 2010/0270318 | A1 | 10/2010 | Dagher | |
| 2010/0295679 | A1 | 11/2010 | Smith | |
| 2011/0095887 | A1 | 4/2011 | Hess | |

FOREIGN PATENT DOCUMENTS

| | | |
|---|---|---|
| JP | 408164932 | 6/1996 |
| JP | 2000/122552 | 4/2000 |
| JP | 2007/065865 | 3/2007 |
| WO | WO-98/26388 | 6/1998 |
| WO | WO-2006/019929 | 2/2006 |
| WO | WO-2006/083453 | 8/2006 |

* cited by examiner

500

500

TOP VIEW
20 FEET
8 FEET
600
602
604

SIDE VIEW
10 FEET
8 FEET

END VIEW
CONTAINER FRAME FOR 20 FOOT
MARITIME SHIPPING CONTAINER

END VIEW
804
804
METAL FRAME
804
800
802
TOP VIEW

TOP VIEW
PRESS AND GLUE PANELS
TO PANEL FRAMES
20 FEET
8 FEET
602
T1
T2
T3
T4
T5
20 FEET
10 FEET
602
R1
R2
R3
R4
R5
RIGHT SIDE
20 FEET
602
L1
L2
L3
L4
L5
LEFTSIDE
8 FEET
10 FEET
602
E1
E2
END
602
D1
D2
DOOR

DATA CONNECTIONS BETWEEN PANELS AND CORNER FITTINGS

CONTAINER WITH INTERIOR ENCLOSURE OF COMPOSITE MATERIAL HAVING EMBEDDED SECURITY ELEMENT

CROSS REFERENCE TO RELATED APPLICATION

This applications claims benefit of U.S. Provision Patent Application Ser. No. 61/022,727 filed Jan. 22, 2008, and Ser. No. 61/055,109 filled May 21, 2008, the entire contents of each of which is incorporated by reference in its entirety.

The subject matter of this application is also related to and can be used in conjunction with the devices and techniques described in U.S. Provisional Application Ser. Nos. 60/782,438 filed Mar. 15, 2007, 60/851,264 filed Oct. 12, 2006, 60/899,212 filed Feb. 1, 2007, 60/899,275 filed Feb. 1, 2007, 60/899,216 filed Feb. 1, 2007, and 60/899,088 filed Feb. 1, 2007, the entire contents of each of which is incorporated by reference in its entirety.

The subject matter of this application is also related to and can be used in conjunction with the devices and techniques described in International Application Ser. Nos. PCT/US2008/001394 and PCT/US2008/001350 both filed Feb. 1, 2008, the entire contents of each of which is incorporated by reference in its entirety.

The subject matter of this application is also related to and can be used in conjunction with the devices and techniques described in U.S. patent application Ser. No. 12/277,100 filed Nov. 24, 2008 and U.S. Pat. No. 7,475,428 issued Jan. 6, 2009, the entire contents of each of which is incorporated by reference in its entirety.

STATEMENT OF GOVERNMENT RIGHTS

This invention was made with Government support under Contract No. N66001-08-D-0010 awarded by the SPAWAR Systems Center, San Diego. The Government may have certain rights in this invention.

FIELD OF THE INVENTION

The present invention relates generally to the field of containers and more particularly to secure containers configured to withstand attempts at intrusion.

BACKGROUND OF THE INVENTION

There has been a recognition that the United States is at risk of the delivery of weapons of mass destruction to its ports by enemies employing a strategy of hiding such a weapon in a shipping container. Various schemes have been proposed for x-raying containers or otherwise examining containers as they are loaded on ships in foreign ports. Such schemes, however, can be very limited in effectiveness since they can be defeated with x-ray shielding, vulnerable to compromise by rogue employees and the contents of the containers altered after they are loaded in a foreign port.

Approximately sixteen million twenty foot containers are in use throughout the world. Additionally, approximately 40% of the personnel that load and off-load these containers come from nations that are on the terrorist list. Bribery and sabotage are common throughout the shipping industry, including government officials, shipping companies and freight forwarders. Large quantities of contraband material now pass through the maritime commerce into most ports in the U.S.

The current shipping containers are primarily made of steel with considerable drawbacks. The steel containers increase shipping weights unnecessarily, wear out quickly, and can be infiltrated by simple means. Other panels not made of steel have been considered, but they are typically not made of weldable material (i.e. material which is suitable for undergoing welding without experiencing a substantial amount of damage). Weldable material such as steel is provided to form a right angel joint between a vertical corrugated frame and a horizontal beam, such as a side panel joining to the upper and lower container frames. By way of contrast, a composite panel can form a very strong glue bond with a metal flange that is in the same plane where the gluing can be accomplished with pressure.

To a limited degree, the notion of enclosing detecting devices, such as sensors or processors, in containers, which communicate with external systems, has been implemented in unsecure applications. For example, Sensitech, based in Beverly, Mass. (www.sensitech.com), provides solutions in the food and pharmaceuticals fields that are used for monitoring temperature and humidity for goods, in-transit, in-storage, and display. Such, temperature and humidity monitors are typically placed in storage and transit containers to monitor if desired conditions are maintained.

However, such data collection is not generally considered sensitive with respect to security issues. Rather, it is used for ensuring that products in a container do not spoil by being subjected to unfavorable temperature and humidity conditions. Secure communications, tamper resistance, and detection are not particularly relevant issues in such settings. Additionally, such monitors do not monitor for the presence of suspicious content or materials, no matter where they may be introduced in the chain.

Even if detectors are introduced into a container and interfaced to an external system, an "enemy" may employ any of a variety of strategies to defeat such a detection system. For instance, an enemy may attempt to shield the suspicious materials or activities from the detectors; defeat the communication interface between the detectors and the external system, so that the interface does not report evidence of suspicious materials or activities sensed by the detectors; disconnect the detectors from the interface; surreptitiously load a container that contains an atomic weapon, but that does not contain detecting devices, onto a container ship; overcome external systems so that they incorrectly report on the status of the detectors.

SUMMARY OF THE INVENTION

The present invention relates to a method of manufacturing, distributing, and utilizing shipping containers such that they may be monitored for unauthorized access. The present invention also relates to methods of making and utilizing inherently secure shipping containers that improve shipping processes and provide a savings in the cost of transportation, increased control, faster throughput, and reduction of losses due to pilferage.

The present invention relates to a security structure, such as a wall or container including composite panels configured with embedded security elements attachable to a welded metal frame. The composite panels, when attached to the frame, form a contiguous surface, such as an enclosure, of the composite material. Beneficially, the contiguous composite surface with the embedded security elements is configured to detect a breach of the security structure. The structure can be assembled using multiple panels of a multilayered composite material that can be attached to other components, for example to a frame or to one or more panels to form a tamper-resistant container, such as a shipping container, without a substantial gap between adjoining composite panels. In addition, each of the panels may contain embedded processors and sensors that can detect any substantial intrusion or tampering with the container.

Some embodiments of the invention relate to a security structure including a weldable frame. The security structure also includes multiple composite panels, each panel securable to the weldable frame, for example, made of metal, such as steel. Each composite panel is configured to form one or more joints with adjacent composite panels when attached to the weldable frame. Each of the composite panels respectively includes an embedded security element, wherein the security element is configured to detect a breach in the composite panel. The weldable frame can include a parallelepiped, with the composite panels attached thereto forming an interior enclosure of contiguous composite material panels. In an alternate form, flanges may extend from the frame members so that the flanges provide support surfaces for the composite panels.

Other embodiments of the invention relate to a method for assembling a security container. The method includes welding together elongated members to form a metal frame defining an "interior" volume. A plurality of composite panels are aligned to substantially enclose the volume defined by the welded metal frame. The plurality of aligned composite panels are subsequently attached to the welded metal frame forming an enclosure of composite material.

As an intermediate, a set of flanges may be welded to the frame members, to provide a peripheral support surface for the composite panels. For embodiments including flanges extending from the frame members, the flanges are welded to the frame members. After the flanges have been welded in place, the composite panels are glued or otherwise secured to the flanges.

In one aspect an apparatus is disclosed including one or more security structures. The one or more security structures includes: a weldable frame; a plurality of composite panels, each panel securable to the weldable frame, each composite panel configured to form at least one joint with at least one adjoining composite panel; and a respective security element embedded within each of the composite panels. The security element is configured to detect a breach in the composite panel.

In some embodiments, a first and a second of the security element embedded, respectively, within a first and a second of the plurality of composite panels are interconnected such that the first security element can detect a breach in the second composite panel.

In some embodiments, the one or more security structures include a first and a second security structure. Each of the security structures include: weldable frame; at least one composite panel, the panel securable to the weldable frame, and a respective security element embedded within the composite panel configured to detect a breach in the composite panel. The apparatus includes a corner joint, where, at the corner joint, at least a portion of the weldable frame of each of the first and the second security structures are welded to each other or to a weldable support member, and at least a portion of a composite panel from the first security structure and at least a portion of a composite panel from the second security structure form an angled joint or substantially contiguous composite material. In some embodiments, the corner joint includes an interconnect between security elements embedded in the first and the second security structures.

In some embodiments, the plurality of security structures form an enclosure surrounding a volume with substantially contiguous composite material. The enclosure may be substantially free of gaps in the contiguous composite material, and includes a plurality of interconnected security elements configured to detect any substantial breach of the enclosure. Some embodiments include a monitor in communication with the plurality of interconnected security elements and configured to monitor for any substantial breach of the enclosure. In some embodiments, the monitor unit is located within the enclosure, and further including a transmitter configured to transmit a signal indicative of a detection of a substantial breach of the enclosure to a receiver located outside of the enclosure.

Some embodiments include a weldable container frame and where at least one weldable frame of the one or more security structures is welded to the container frame. Some embodiments include a metal shipping container, the shipping container surrounding the enclosure and including at least a portion of the weldable container frame. In some embodiments, the enclosure substantially conforms to the interior shape of the metal shipping container.

In some embodiments, the at least one joint includes at least one chosen from the list consisting of: a butt joint, a lap joint, a mitered joint, a dado.

In some embodiments, the security element includes a conductive element or a waveguide.

In some embodiments, where each composite panel of the plurality of composite panels is fastened to the frame using at least one chosen from the group consisting of: a chemical fastener, glue, epoxy, cement.

Some embodiments include a composite member including a security element, the elongated composite member configured to cover a gap between adjacent composite panels forming the enclosure.

In another aspect, a method is disclosed including assembling one or more security structures by, for each security structure, forming a weldable frame; aligning each panel of a plurality of composite panels to form a substantially contiguous composite surface with the other panels, each of the composite panels including an embedded security element configured to detect a breach of the composite panel; and attaching each panel of the plurality of aligned composite panels to the weldable frame thereby forming a contiguous composite surface attached to the welded metal frame.

Some embodiments include interconnecting a plurality of the embedded security elements.

In some embodiments, one or more security structures include a plurality of security structures. The method may further include: arranging the security structures to form an enclosure surrounding a volume with substantially contiguous composite material. In some embodiments, the enclosure is substantially free of gaps in the contiguous composite material, and includes a plurality of interconnected security elements configured to detect any substantial breach of the enclosure.

Some embodiments include monitoring for a detected breach of the enclosure.

Some embodiments include, prior to attaching each panel of the plurality of aligned composite panels to the weldable frame of each security structure, welding the weldable frame of one or more of the security elements to the weldable frame of another of the one or more of the security elements or a weldable container frame.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

Exemplary dimensions are shown in various figures. However, other suitable dimensions may be used.

DETAILED DESCRIPTION OF THE PREFERRED EMBODIMENTS

This disclosure relates to using composite materials to embed sensors (e.g. intrusion detection sensors), whereby the composite materials form composite panels, which are then joined together to form a substantially continuous composite surface that will enclose a volume, as in a container. Composite panels thus formed can be used to produce maritime shipping containers, air cargo containers, truck bodies or other types of containers in circumstances where the government or industry wishes to detect breach of or an intrusion into the protected volume.

This type of technology is useful to protect the United States from an adversary attempting to use shipping containers of various sorts to introduce weapons of mass destruction, such as nuclear weapons, chemical or biological weapons, or dirty bombs into the United States.

As disclosed in U.S. Provisional Patent Application No. 60/872,956 (converted Oct. 3, 2007 to U.S. patent application Ser. No. 11/866,655), entitled "Composite Weldable Panel with Embedded Devices," filed on Dec. 4, 2006, a composite panel may be first formed, and then pressed and glued onto a frame which surrounds the panel. The panel with its composite-glued-in frame is then welded to a container frame, such as a frame for a maritime container. The technology described in the referenced application includes a metal band surrounding the composite material. This could be a metal band around the entire perimeter of a panel, or complete side of an assembled container. Even if intrusion detection devices were embedded in such composite panels, it may be possible for an adversary to break through the metal band without encountering any of the intrusion detection devices.

Figure 1A:
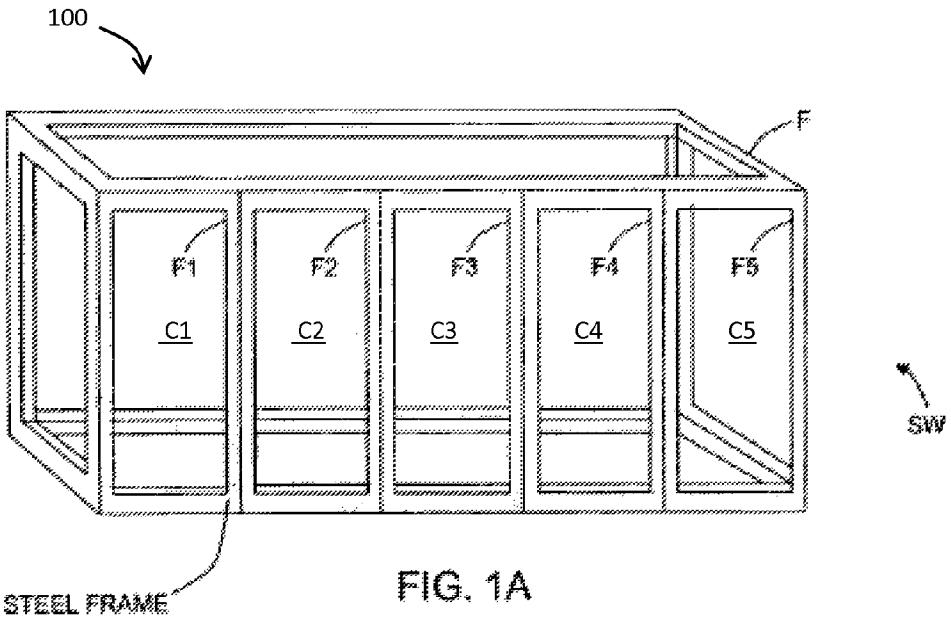
FIG. 1A is a schematic diagram illustrating a front perspective view of a container frame including steel perimeters attached thereto to support a sidewall including multiple composite panels.

FIG. 1A shows a container frame F of container 100 with a single sidewall SW attached to the frame from the front, as shown. The container sidewall includes five composite panels C1-C5, having a metal frame F1-F5, joined together at their respective sides, for example, by welding of the panel frames, in accord with the disclosure of U.S. Provisional Patent Application No. 60/872,956 (converted Oct. 3, 2007 to U.S. patent application Ser. No. 11/866,655). The container sidewall is joined to frame F at its periphery, for example, by welding. The shaded areas F1-F5 surrounding these panels C1-C5 (shown as transparent in the figure) represent the bands of steel F1-F5 which have no cover of composite material. Portions of bands F1-F5 are welded to steel frame F. The breadth of the metal bands permits welding to frame F without heat damage to the composite material panels C1-C5.

The technique described herein involve forming the composite material/metal container with a substantially continuous outer composite surface that completely envelopes the enclosed volume. Rather than gluing the composite material first to a surrounding metal frame and then welding the surrounding metal frame to a container frame, a panel frame is first welded to a container frame. The composite panels are subsequently pressed and glued, or otherwise adhered (e.g. using a chemical fastener, glue, epoxy, cement, etc.), to the surrounding frame after the surrounding frame has already been welded to the container frame. Since the welding has already taken place prior to application of composite panels, the composite panels can be pressed and glued into their frames, in the immediate vicinity of the weld joints, such that they adjoin or overlap one another, without danger of heat damage.

Figure 1B:
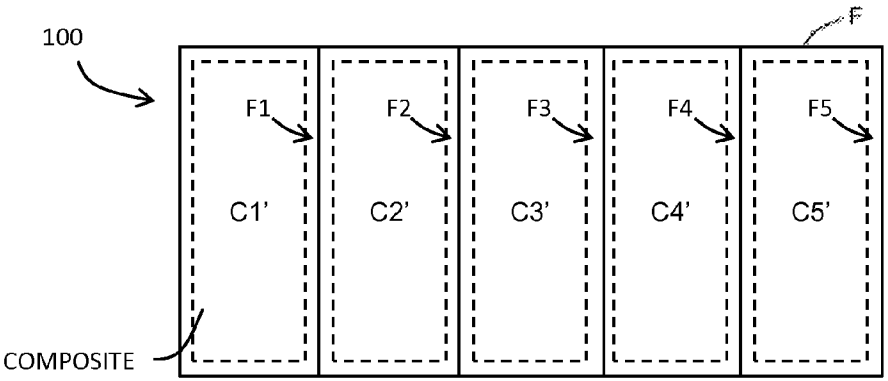
FIG. 1B is a schematic diagram illustrating a side wall of a container.

FIG. 1B shows an "outside" plan view of composite panels C1'-C5' in this arrangement as attached to the outside of the frame structure of container 102. There are no steel bands exposed without composite covering. As indicated by the dashed lines, the steel bands F1-F5 reside underneath the composite and shown in phantom. Since there are no particular restrictions of placement of the composite with respect to the weld joint, the composite material panels C1'-C5' may overlap one another under this arrangement.

With a contiguous surface of composite material constructed in this fashion, and with the composite panels corrugated as they may be with current steel containers, additional procedures can be implemented to provide appropriate joints where the corrugations come together.

Where the corrugated end panels adjoin the roof panels in which the corrugations are running across the width of the panel, the corrugated panels coming up from the end need to be joined to a flat surface presented by sides of the roof panels. For steel corrugated panels, the joint can be achieved by welding the corrugated sides to the bottom of the corrugated roof panels. However, a joint of this nature is not possible for composite panels.

Figure 2A:
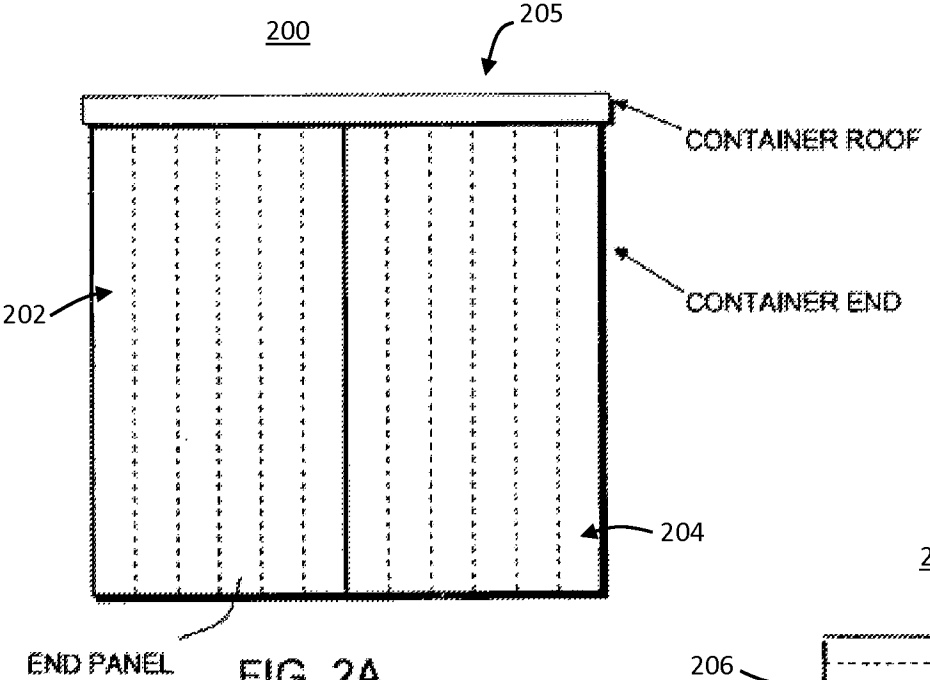
FIG. 2A is a side elevation view of an end of a container.
Figure 2B:
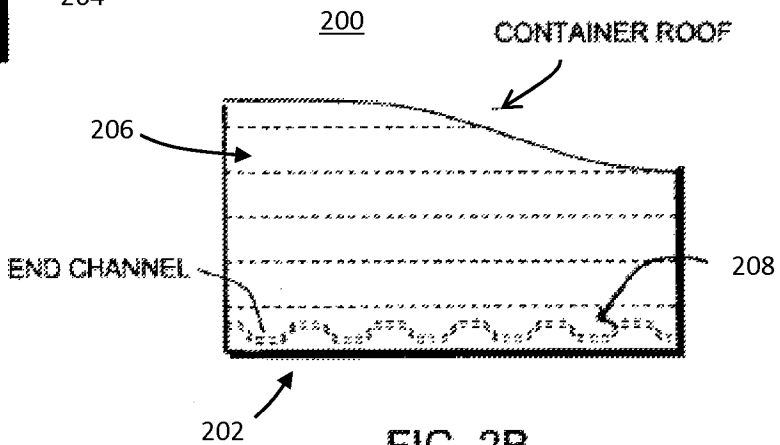
FIG. 2B is top planar view of an end portion of the container illustrated in FIG. 2A.
Figure 3A:
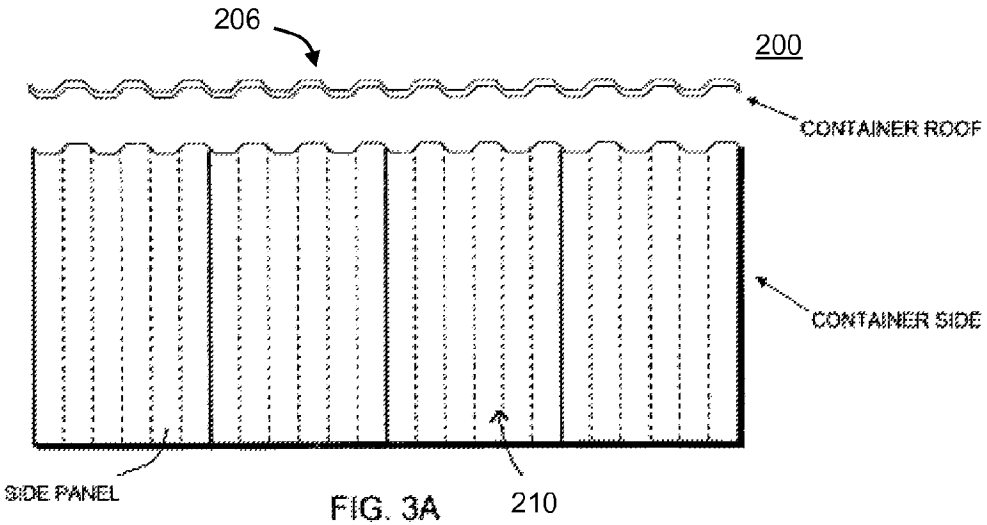
FIG. 3A is a side view of an end of a container.
Figure 3B:
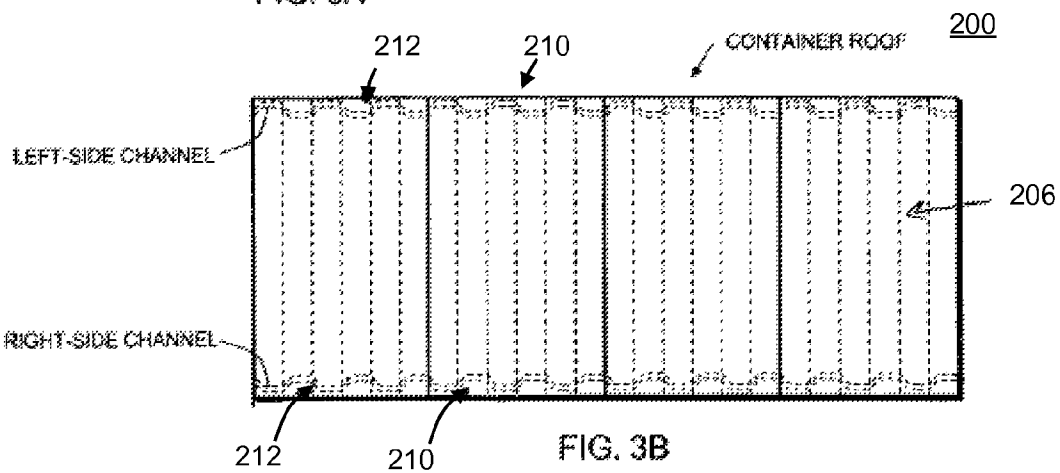
FIG. 3B is a side view of an end of a container.

FIG. 2A is an end view of a container 200. The corrugations (indicated by dashed lines) of the end panels 202, 204 are arranged vertically. Preferably, corrugations of the vertically arranged end panels 202, 204 fit with a metal frame element that matches end panels into which composite panels can be glued. Such an orientation can provide a flat surface along the underside of the end of the roof 206 adjoining a top edge of the side panels. As shown in FIG. 2B, the roof panel consists of corrugations that are glued onto a metal frame with identical geometry that are welded to the container frame. An end channel 208 is formed where end panel 202 or 204 meets with roof paned 206. Similarly, FIGS. 3A and 3B show a side and top view of container 200. Corrugated side panels 210 meet corrugated roof 206 to form side channels 212.

Figure 4:
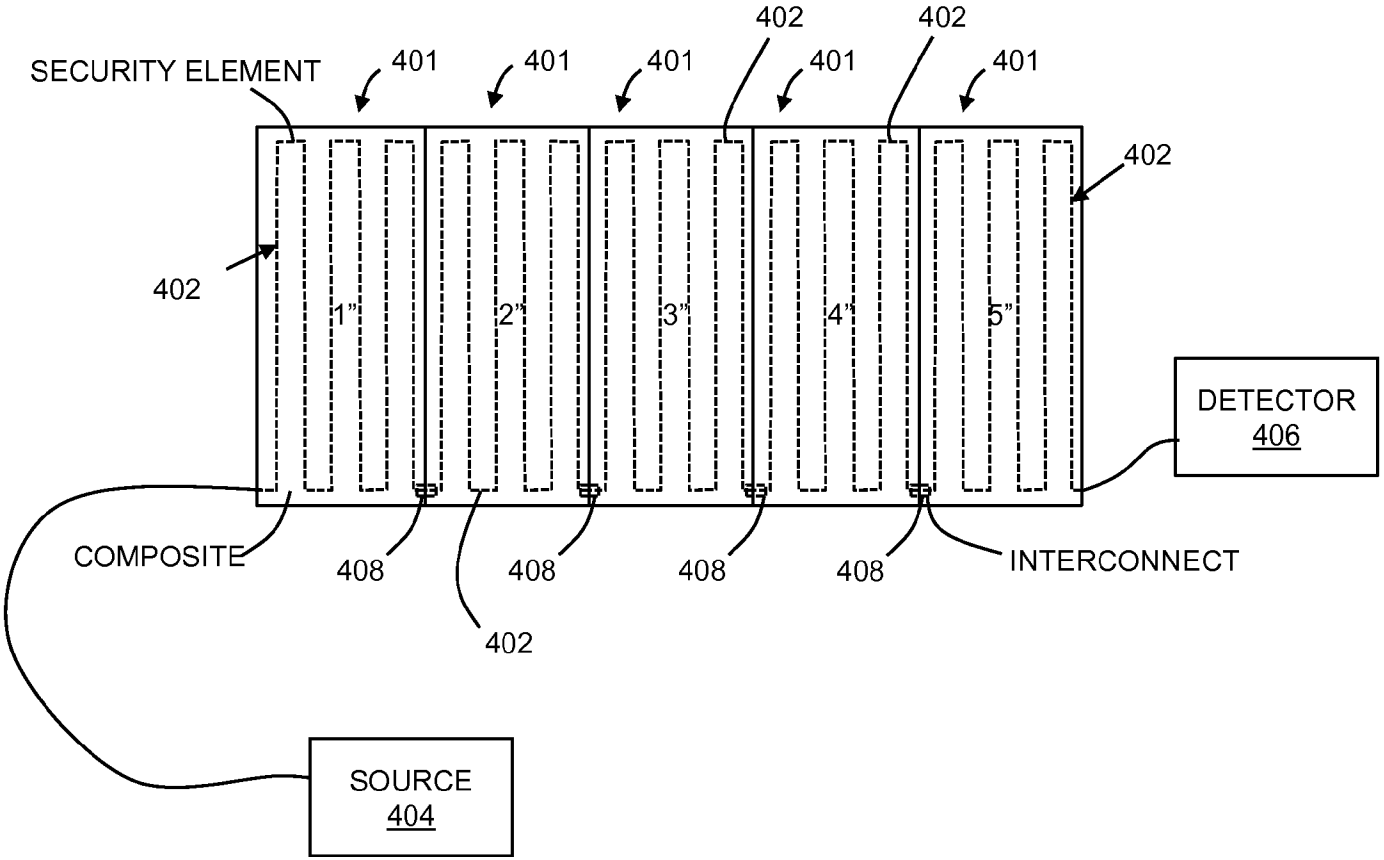
FIG. 4 is a schematic diagram illustrating an alternative embodiment of a side of a container wall.

Referring to FIG. 4, one or more of the container panels 401 include a security element 402. Within each panel, the security element 402 is configured to identify or otherwise detect a breach or attempted breach of the respective panel. The security elements 402 can include one or more of an electrical conductor and a fiber optic cable. Such elongated security elements can be arranged in a pattern to cover the respective panel, leaving gaps no greater than a specified size. For example, in some embodiments the security elements leave gaps with a characteristic size of no greater than about 1 mm, no greater than about 1 cm, no greater than about 10 cm, no greater than about 1 m, etc. as chosen for the application at hand. Suitable patterns include serpentine patterns, grids, geometric shapes, random paths, and combinations of one or more of these patterns. A breach or attempted breach of such a composite panel would sever one or more paths of the security element.

In some embodiments, the security elements are driven by an energizing source 404. For example, an energizing source 404 can be a laser or light emitting diode for a fiber optic security element 402. Alternatively, an energizing source 404 can be an electrical power source for an electrically conducting security element. In addition to the energizing source 404, the security elements are coupled to one or more energy detectors 406 receiving energy from the security elements 402. For example, the detectors 406 can include photodetectors, phototransistors, avalanche photodiodes, charge coupled devices, or any other suitable detector, for detecting energy received from a fiber optic security element. Detectors 406 can also include a meter, current source, an indicator, or any other suitable electrical device for detecting energy received from the security element. In operation, when one or more of the security elements are severed, the amount of received energy at the one or more detectors is varied.

An exemplary container wall is illustrated in FIG. 4. The container wall includes five panels labeled 1", 2", 3", 4", 5". Each of the five panels is glued or otherwise fastened to a container frame, not visible in the figure. The panels can be arranged to either abut or overlap adjoining panels. A serpentine security element is shown as being embedded within the composite panel. For example, the security element 402 may be an elongated (electrically or optically) conductive element, such as a wire or ribbon or optical fiber, that is arranged in a serpentine patter to substantially cover the entire panel. The security element 402 can be positioned on one of the outer sides of the panel, or more preferably embedded at least partially within the composite panel 401 during its manufacture. In the exemplary embodiment, the serpentine pattern is such that the security elements 402 match up at interconnects 408 along adjacent panels. Such alignment can be used for interconnecting the security elements between adjoining panels. Thus a single energy source and/or detector can be used to monitor the integrity of multiple panels. In some embodiments, security elements 402 in all of the composite panels 401 of a container are interconnected.

Interconnects 408 can be formed using jumper straps attached using one or more of mechanical fasteners, conductive chemical fasteners, and soldering. In some embodiments, the embedded security elements align with each other in an overlapping joint with an adjoining panel. A conductive fastener, such as a rivet, a screw, a nail, or a staple can be used to pierce the overlapping edges of the composite panels at the location of the aligned security elements. With such an arrangement, the conductive fastener forms a via providing a conductive path between the security elements of multiple panels 401.

For optical security elements, interconnects 408 can be formed using connectors or splices. Alternatively or in addition, optical security elements can terminate in an optical waveguide or light pipe extending to a surface and/or edge of the composite panel. In such an arrangement, an abutting or overlapping joint at which such features overlap on different panels can be used to provide coupling of optical energy between the panels.

Figure 5B:
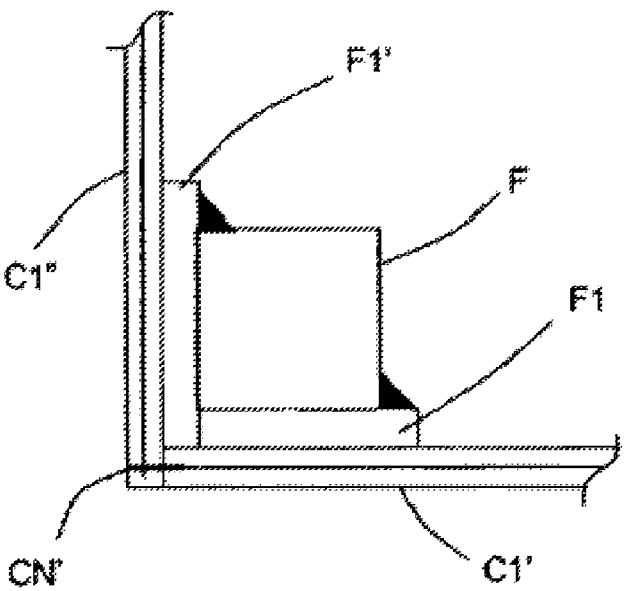
FIG. 5B shows a sectional view of a corner of an alternative embodiment of a container.
Figure 5A:
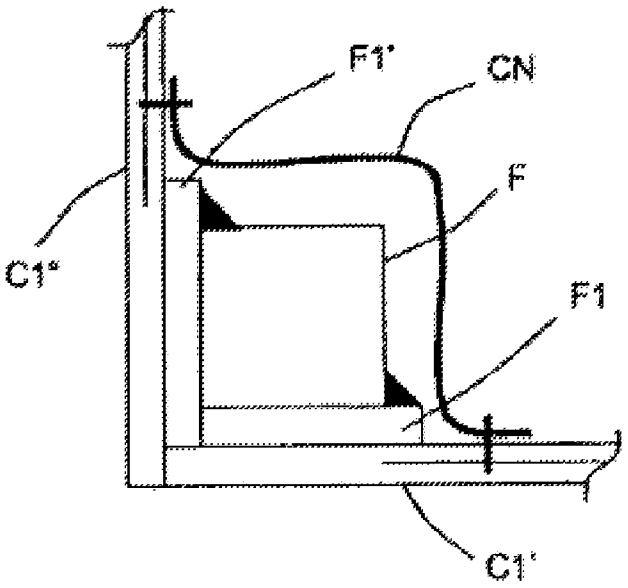
FIG. 5A shows a sectioned view of a corner of one embodiment of a container.

FIG. 5A shows a sectional view of a corner joint 500 of the container of the type shown in FIG. 1B, where the frame F1 of a composite side panel C1' is welded to frame F of the container, and the frame F1' of a composite end panel C1" is welded to frame F. The composite materials of panels C1' and C1" abut, forming a contiguous outer surface of composite material for the container. A connector CN is illustrated, which provides electrical connectivity from electrically conductive security element arrays embedded in panels C1' and C1". Optical interfaces may similarly be provided for panels with optical fiber security element arrays. Connections to the security elements can alternatively be established at the junction of the composite materials of panels C1' and C1". FIG. 5B shows a sectional view of a corner joint 500 of an alternative embodiment of a container. In this embodiment, the connector CN' is provided along an outer edge of the adjoining composite panels C1' and C1."

Figures 6A, 6B, 6C:
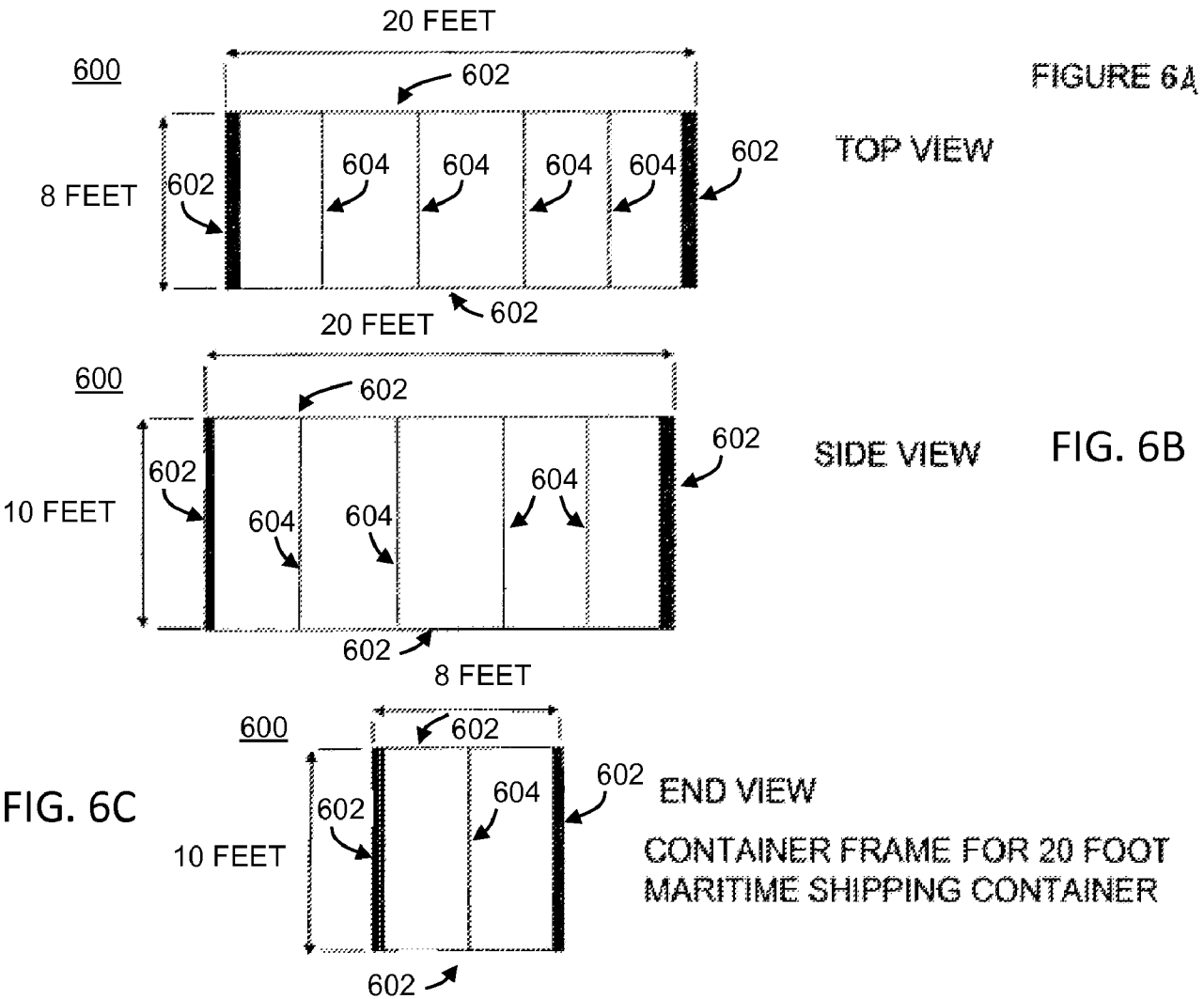
FIGS. 6A-6C show top, side, and end views of an exemplary container frame.

FIGS. 6A, 6B, and 6C shows, respectively top, side, and end views of an embodiment of a container frame 600. Each wall of the container frame includes an outer frame 602 (i.e., a rectangular frame) with one or more inner frame members 604 forming studs, or ribs spanning at least one pair of adjacent sides of the rectangular frame as shown. In some embodiments, one or more of the frame members are made of a weldable material, such as a metal.

Figure 7:
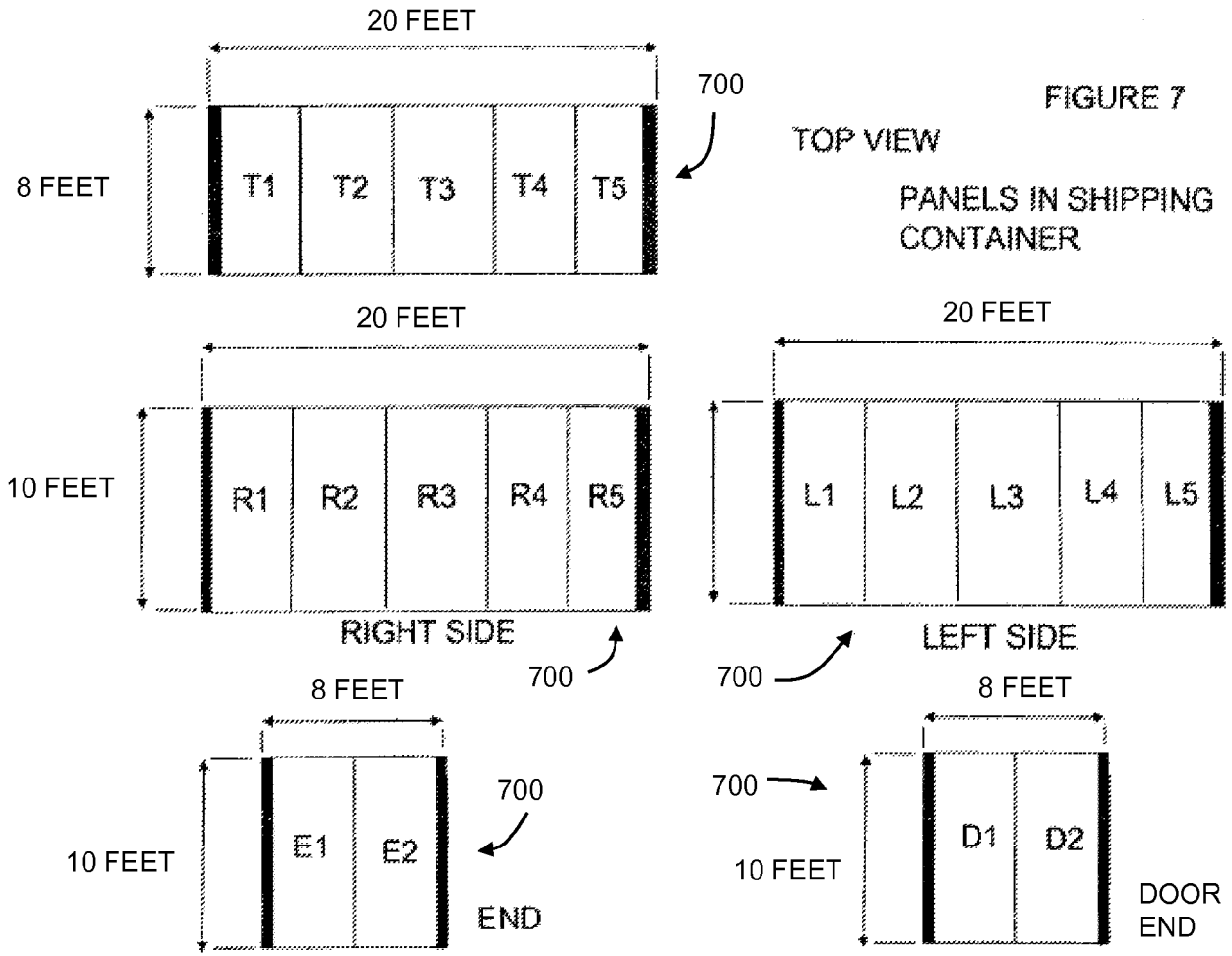
FIG. 7 shows top, left side, right side, and end views of panels of an exemplary container.

FIG. 7 shows top, left side, right side, and end views of composite panels of an embodiment of a container 700 (labeled T1-T5, R1-R5, L1-L5, E1-E2, and D1-D2). Each of the composite panels is formed of a composite material, such as a reinforced resin-based material, e.g., fiber glass, with an embedded security feature. The security feature can be one or more of an electrically conducting wire, an electrically conducting ribbon, and a fiber optic cable. In some embodiments, the security feature is an elongated member formed in a serpentine pattern spanning a substantial area of the respective composite panel. Alternatively or in addition the security feature is a grid, or screen spanning a substantial area of the respective composite panel.

Figure 8:
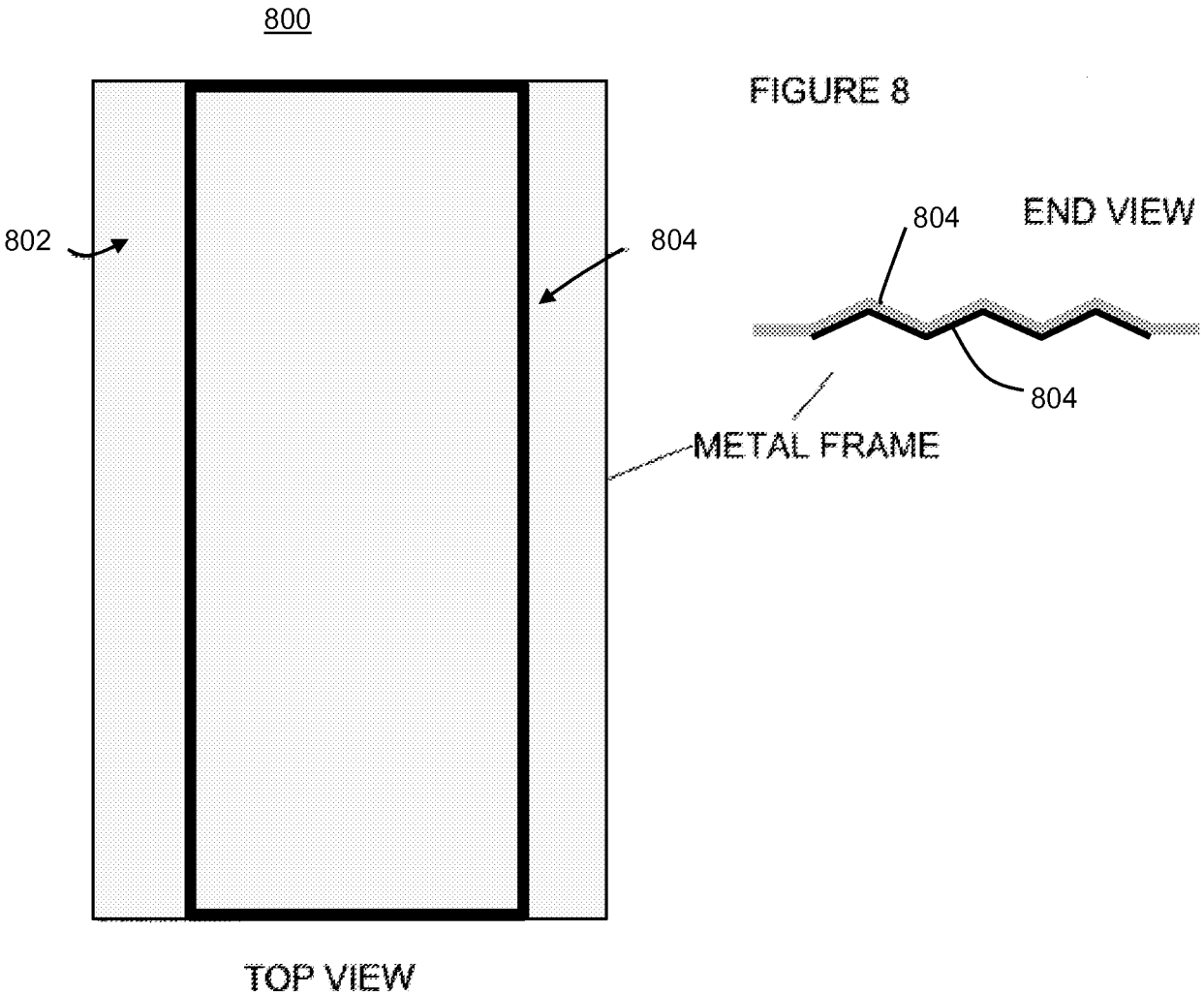
FIG. 8 is a top view of an exemplary composite panel/frame assembly.

FIG. 8 shows a top and end view of an embodiment of a composite panel/frame assembly 800 according to the present invention. The assembly includes a rectangular, generally planar composite panel 802 attached to a rectangular weldable frame 804. As shown, the composite panel 802 may have a pattern, such as a corrugation, or ripple in at least one direction. The weldable frame 804 can be a metal frame. In some embodiments, the metal frame 804 is shaped or otherwise formed to match a non-planar pattern of the composite panel 804, to ensure that intimate contact is maintained between the frame 804 and the respective composite panel 802. As shown in end view, a frame member 804 follows the same corrugated shape 802 as the adjacent end of the composite panel.

Figure 9:
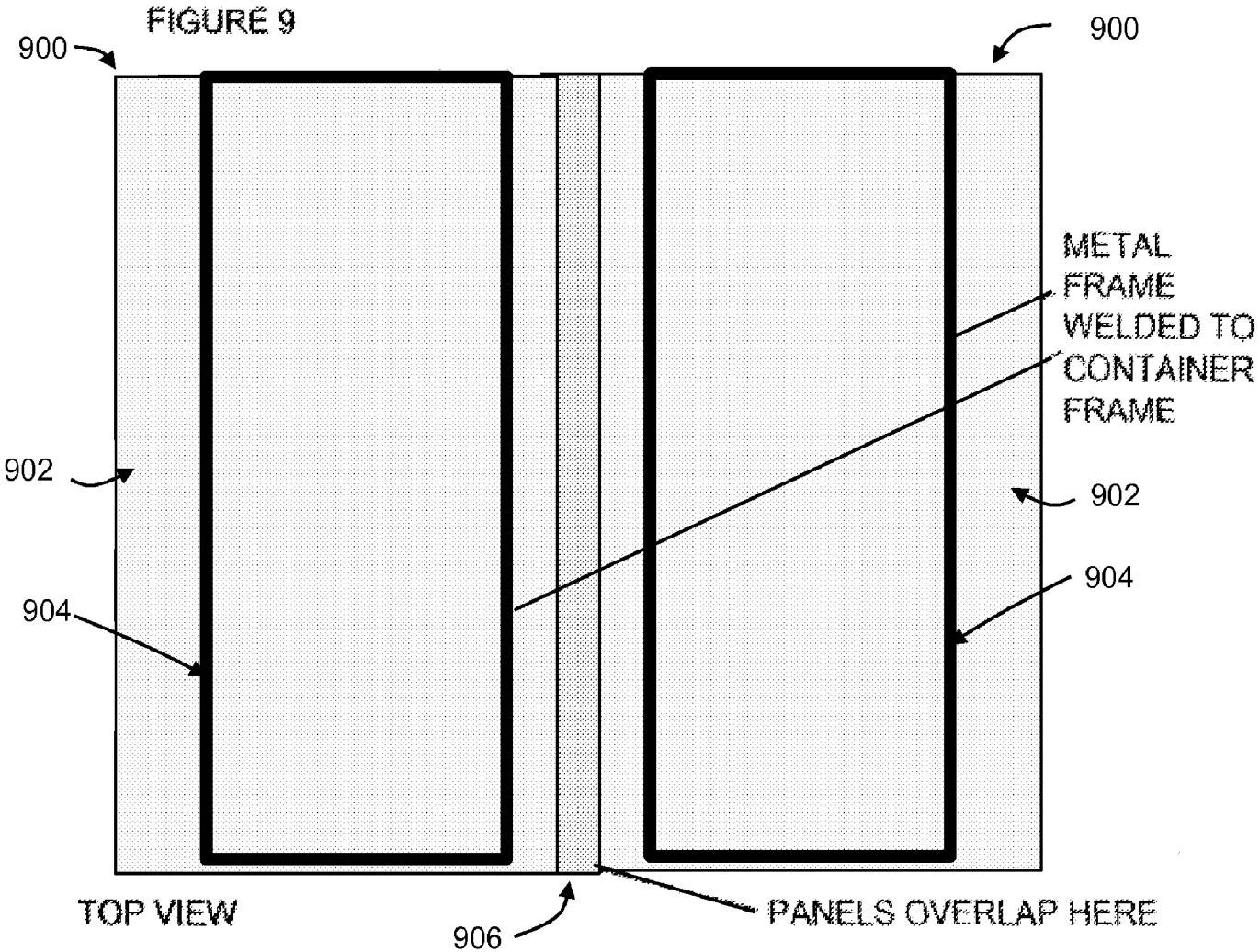
FIG. 9 is a top view of two overlapping exemplary composite panel/frame assemblies.
Figure 10:
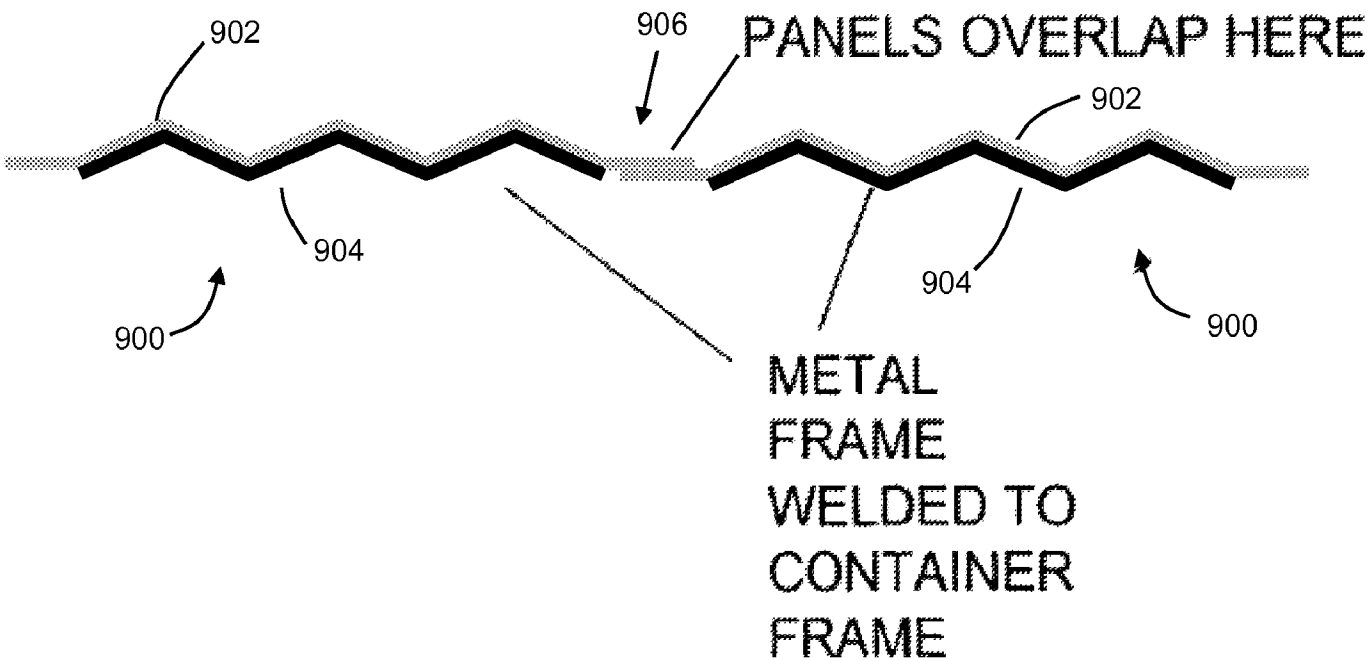
FIG. 10 is an end view of the two overlapping exemplary composite panel/frame assemblies of FIG. 9.

FIG. 9 is a top view of two overlapping exemplary composite panel/frame assemblies 900 according to the present invention. For example, two composite panel/frame assemblies 902, similar to that shown in FIG. 8 each have overhanging panel edges that extend beyond their respective weldable frame assemblies 904. When panels 902 are positioned side by side, at least a portion 906 of adjacent composite panel overhangs can be arranged in an overlapping arrangement, as shown. Such overlap 906 can be used to maintain integrity of a contiguous composite surface (i.e., without any gaps or breaks). Such overlap can also be used to facilitate contact between security features positioned within each of the adjacent panels. FIG. 10 shows an end view of the two overlapping exemplary composite panel/frame assemblies 900 of FIG. 9 in overlapping engagement.

Figure 11:
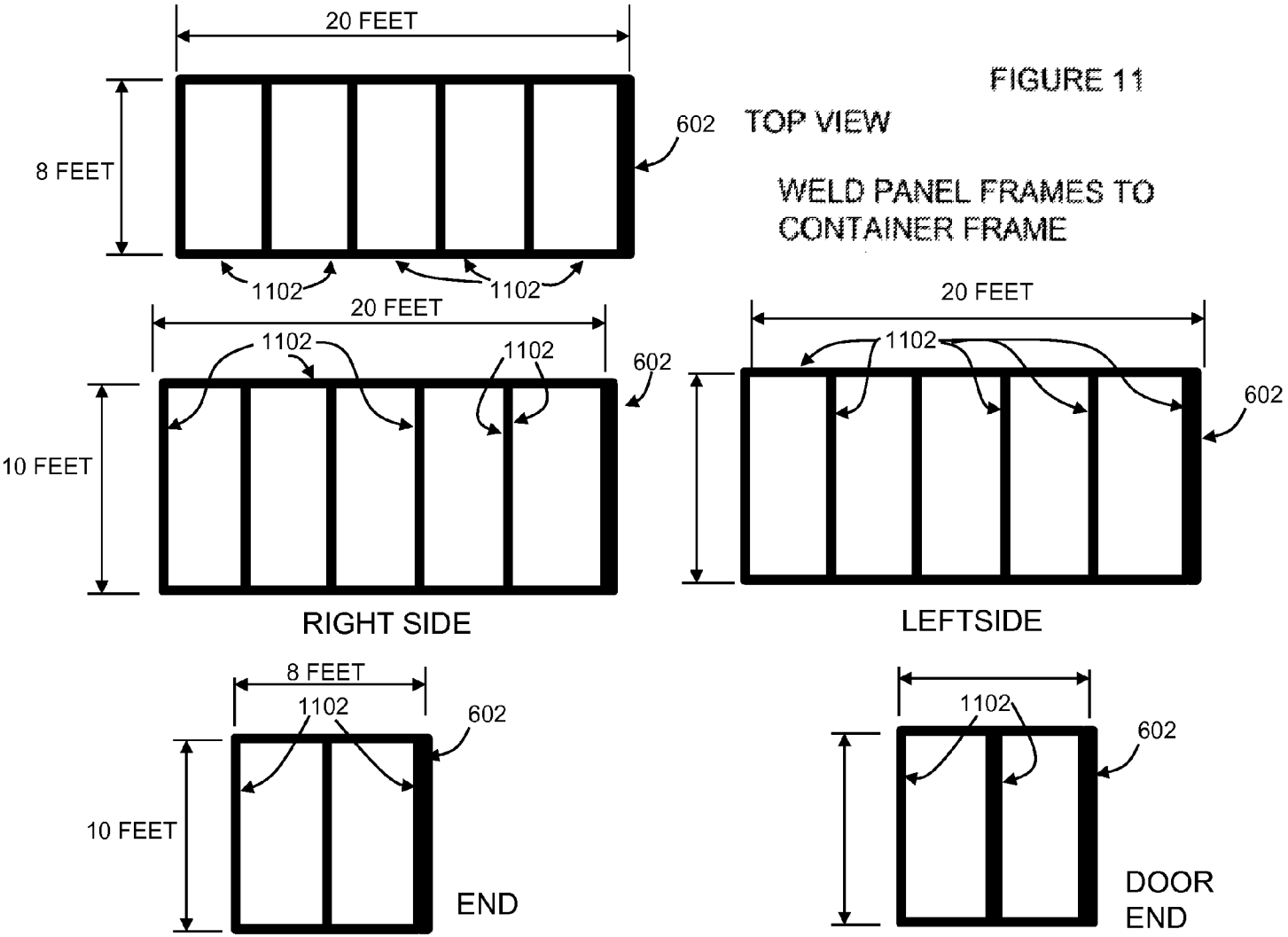
FIG. 11 shows top, left side, right side, and end views of panel frames welded to the exemplary container frame of FIG. 6.
Figure 12:
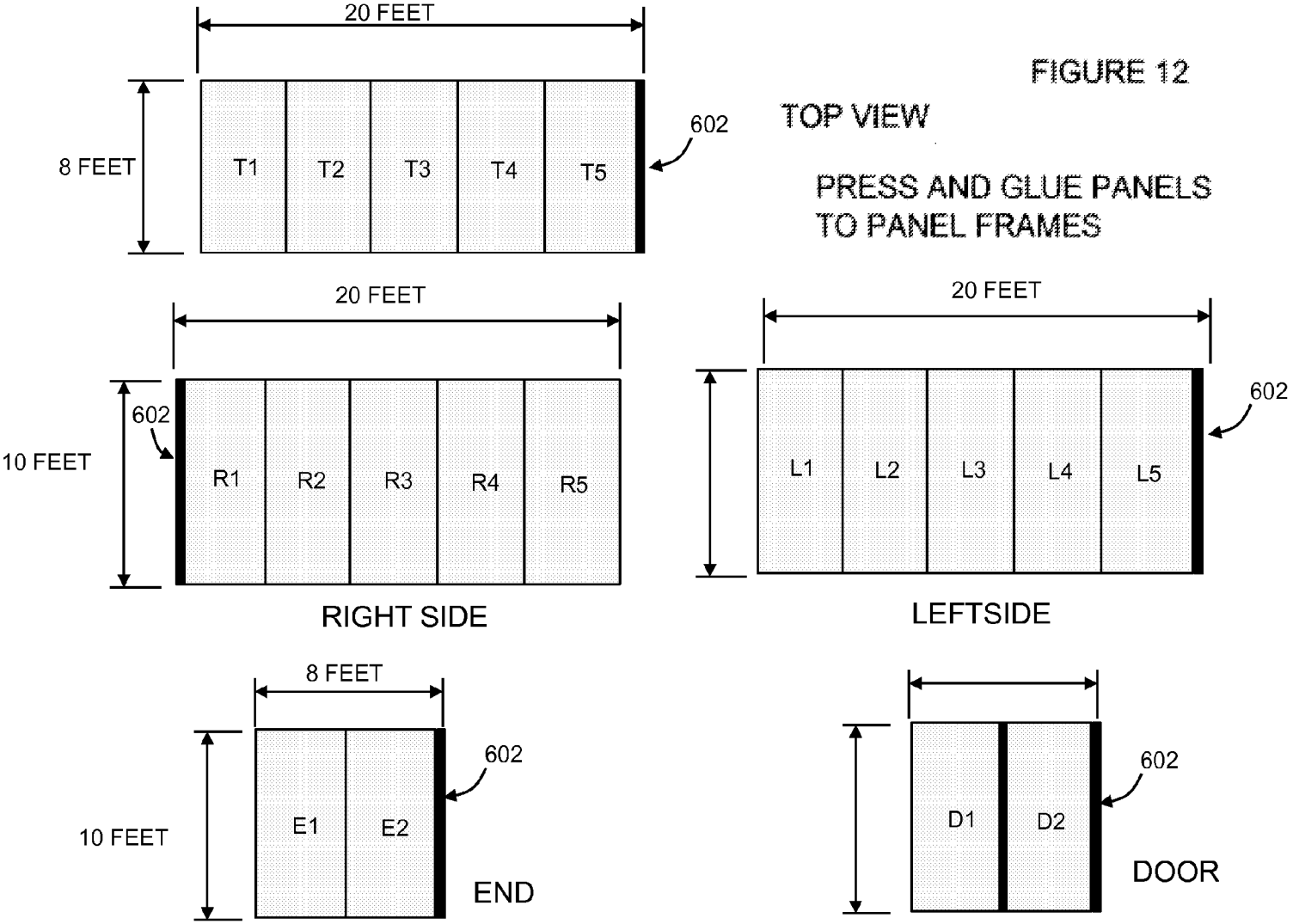
FIG. 12 shows top, left side, right side, and end views of composite panels fastened to the panel frames shown in FIG. 11.

FIG. 11 shows top, left side, right side, and end views of panel frames 1102 welded to the exemplary container frame 602 of FIGS. 6A-6C. For metal to metal bonding, standard welding techniques can be applied. FIG. 12 shows top, left side, right side, and both end views of composite panels (labeled T1-T5, L1-L5, R1-R5, E1-E2, and D1-D2, respectively) fastened to the panel frames 1102 in FIG. 11. When suitably positioned on the frames, and with the frames suitably welded to the container frame, a contiguous composite surface is formed around at least the left, right, end, door end, and top sides of the parallelepiped of the container. In some instances, a composite panel is also positioned along a floor of the container to form an enclosed volume. One or more of the composite panels can be provided on the inside of the frame, or on the outside of the frame.

Figure 13:
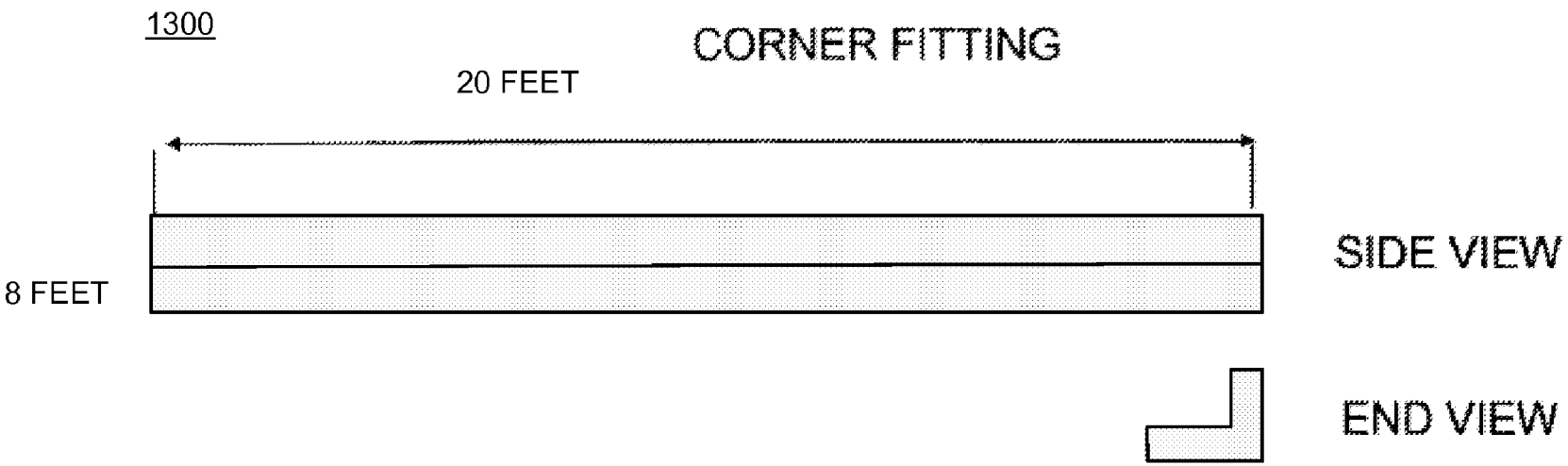
FIG. 13 shows side and end views of a composite corner fitting.

FIG. 13 shows side and end views of a composite corner fitting 1300 according to the present invention. The corner may also includes an embedded security feature (not shown) that can be the same type of embedded security feature used in the composite panels of the top, sides, front, back, and floor (e.g. panels T1-T5, L1-L5, R1-R5, E1-E2, and D1-D2, respectively). One or more corner fittings 1300, alone or together, are dimensioned to extend along substantially an entire edge of the container. Thus, the one or more composite corner fittings are positioned to detect any breach or intrusion along an adjacent frame member of the corner.

Figure 14:
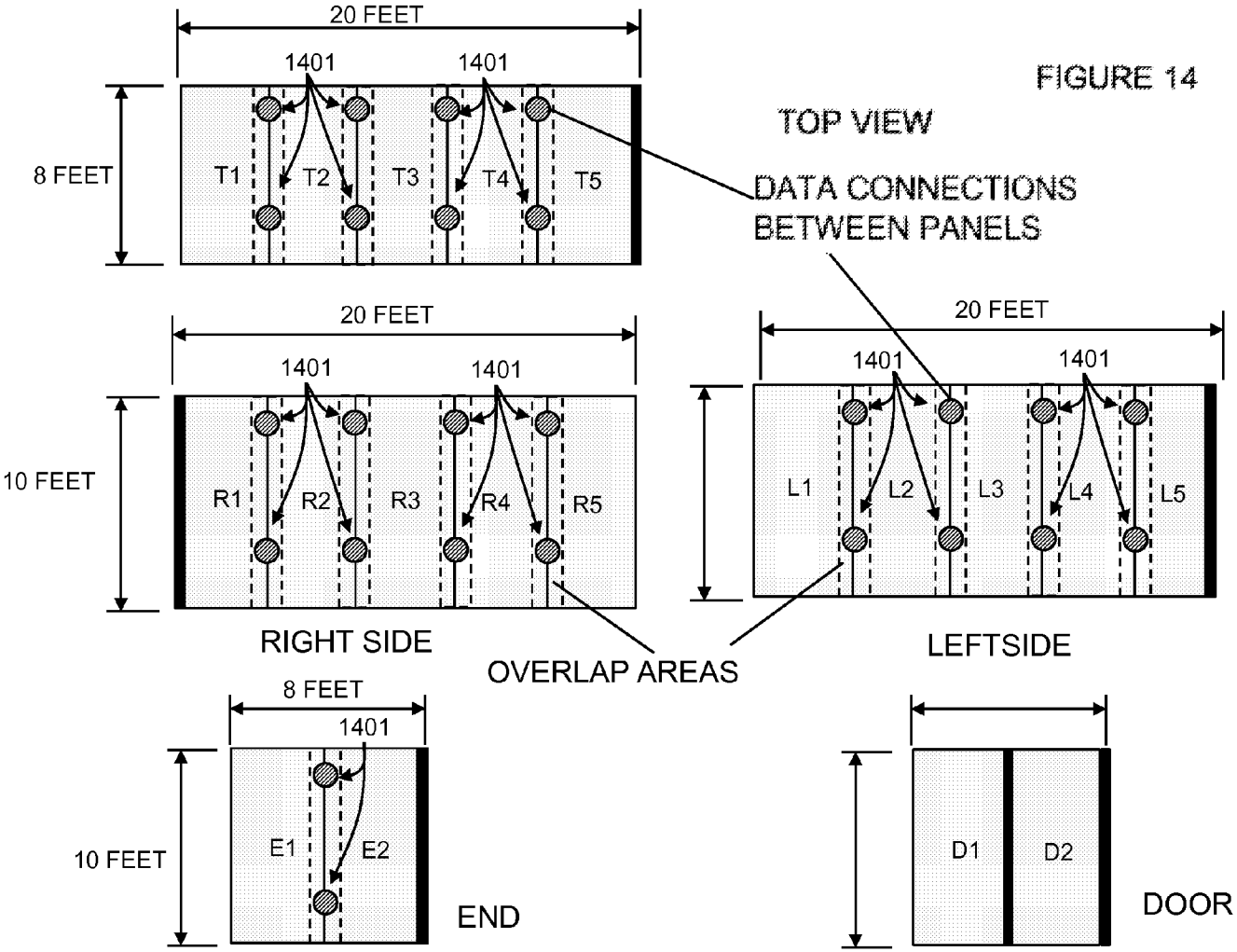
FIG. 14 shows top, left side, right side, and end views of overlapping composite panels including data connections between panels.
Figure 15:
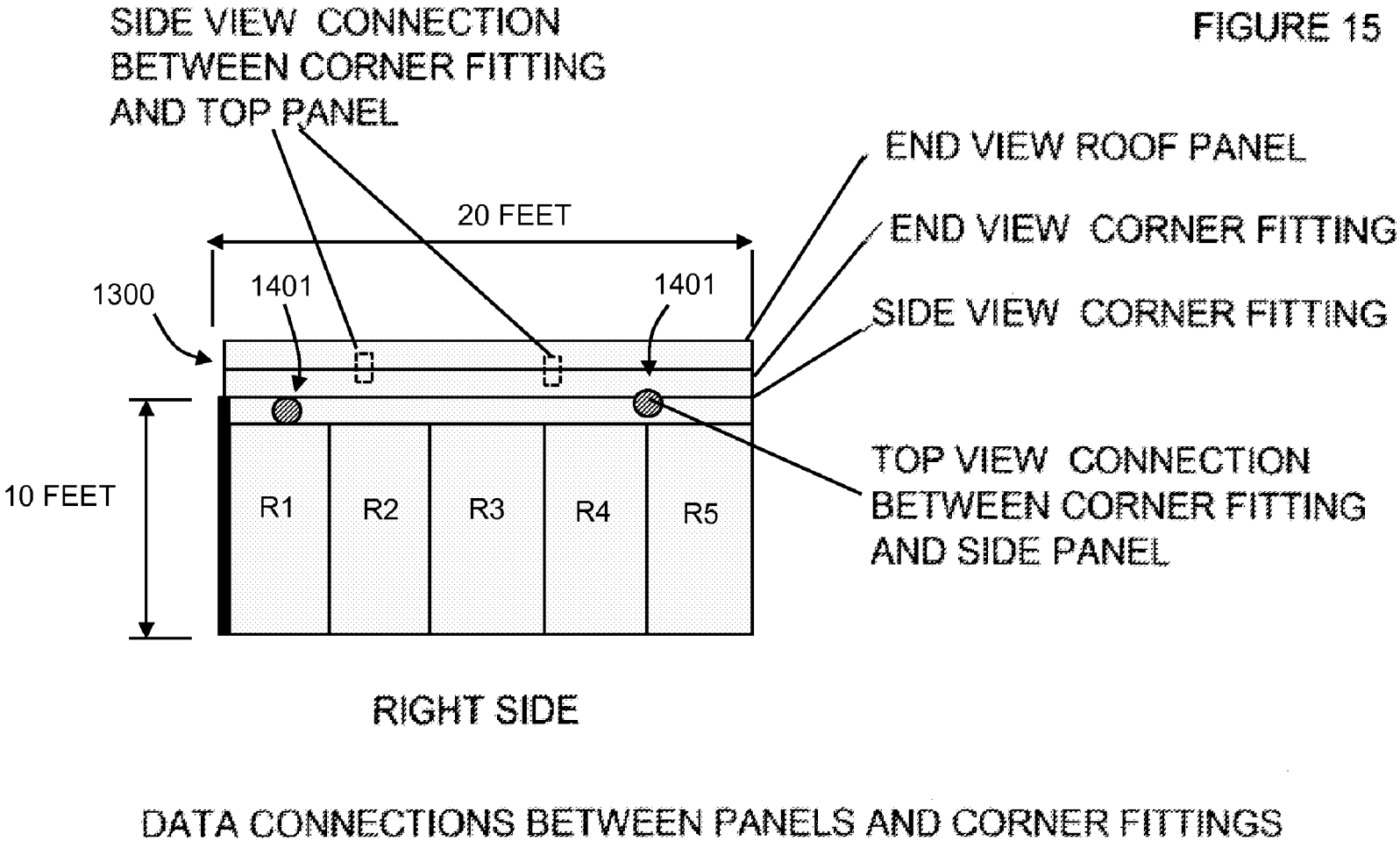
FIG. 15 shows data connections between composite panels and corner fittings.

FIG. 14 shows top, left side, right side, and end views of overlapping composite panels (labeled panels T1-T5, L1-L5, R1-R5, E1-E2, and D1-D2) including security interconnections 1401 (e.g. data connections) provided therebetween. Overlap regions of the composite panels are indicated with dashed lines. The type of connections depends upon the type of security feature embedded within the composite panel. For simple electrical conductors, the connections can include an electrically conducting fastener, such as a screw, a nail, or a staple extending across at least a portion of adjacent panels and in electrical contact with the respective embedded security feature and providing an electrically conducting path therebetween. In some embodiments, the embedded security feature is a cable, such that the data connections are mating cable connectors. Alternatively or in addition, the security feature is an optical waveguide, such as an optical fiber. For such embodiments, the data connections may be fiber optic cables, optical waveguides, otherwise known as light pipes joining together optical paths of adjacent panels. The number and position of connectors 1401 depends upon the circuit configuration or layout of the security feature. For series or parallel connections, generally at least two data connections between along each panel edge suffice. Similar connections 1401 can be provided between composite panels and corner fittings 1300 according to the present invention, as shown in FIG. 15.

Figure 16:
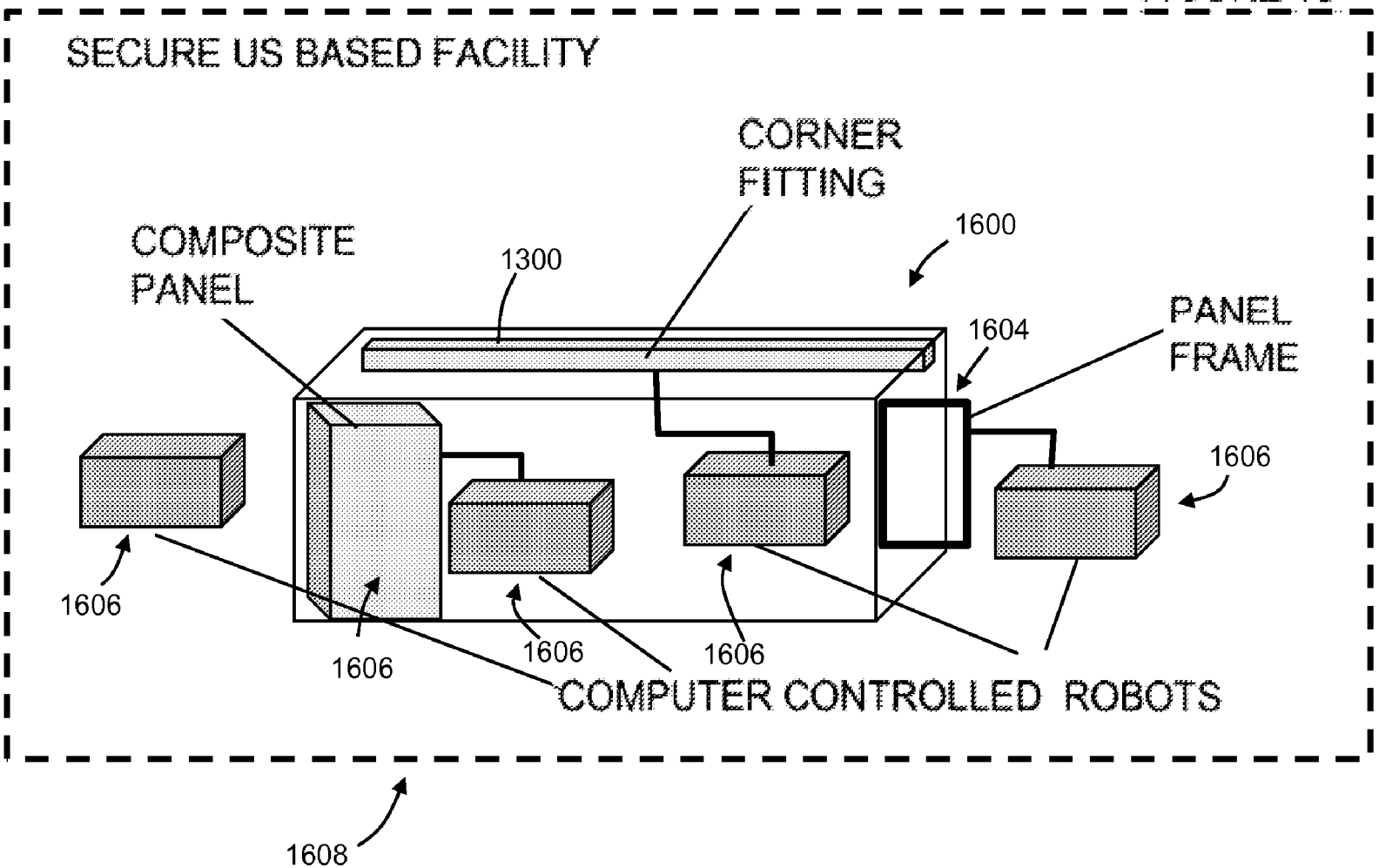
FIG. 16 shows an exemplary setup for manufacturing composite containers.

FIG. 16 shows an exemplary setup for manufacturing composite containers 1600 according to the present invention. For example, one or more of the composite panels 1602, the panel frame 1604, and the corner fitting 1300 can be positioned and installed either manually or automatically, using robots 1606 located inside or outside of container 1600. The construction may be performed in a secure facility 1608 (e.g. one based in the United States).

Figure 17A:
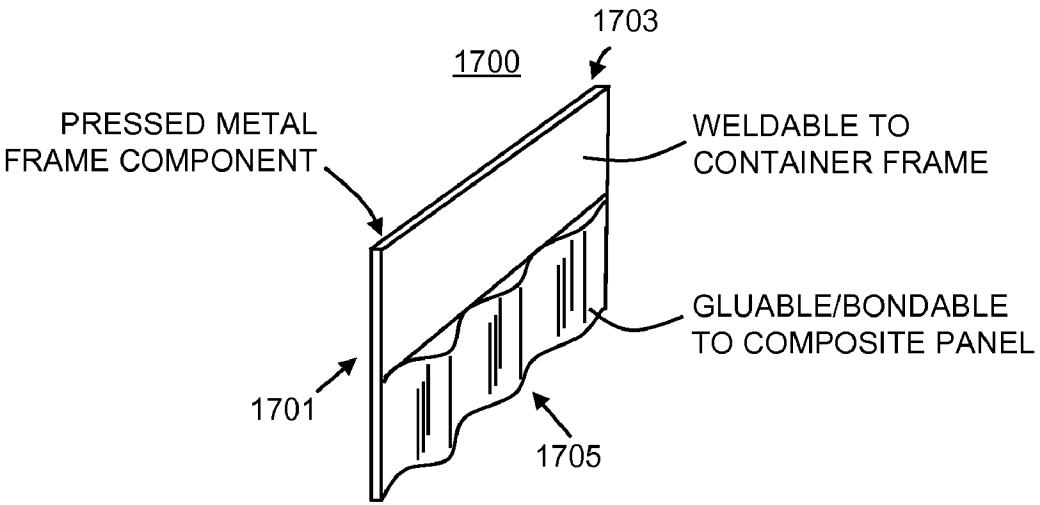
FIG. 17A, FIG. 17B, FIG. 17C, and FIG. 17D show perspective views of panel frame edges.

FIG. 17A shows a perspective view of an embodiment of a panel frame edge 1700 according to the present invention. The panel frame edge includes an elongated weldable panel member 1701 including a substantially flat portion 1703 and a shaped portion 1705. The flat portion 1703 is disposed along one elongated edge and the shaped portion 1705 along an opposite elongated edge. Preferably the shaped portion 1705 is configured for intimate engagement with an edge of a shaped composite panel (not shown). The shape may be an oscillating shape corresponding to corrugation of the composite panel.

Figure 17B:
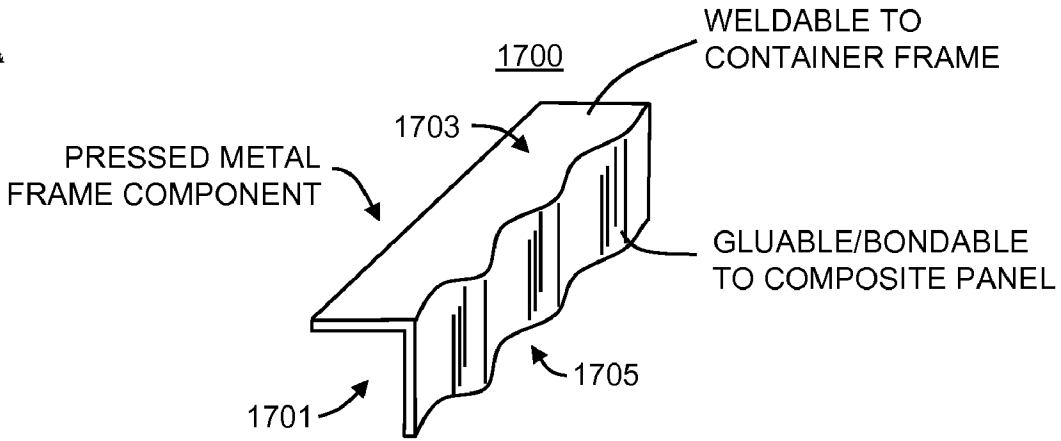

FIG. 17B shows a perspective view of an alternative embodiment of a panel frame edge 1700, in which the substantially flat portion 1703 is positioned within a plane oriented at 90 degrees to a plane aligned with the shaped portion 1705. From an end view, the panel edge forms an "L" shape as shown.

Figure 17D:
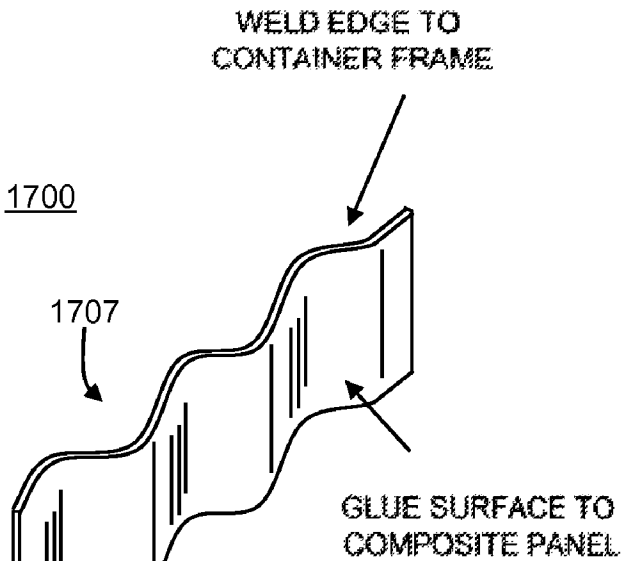
Figure 17C:
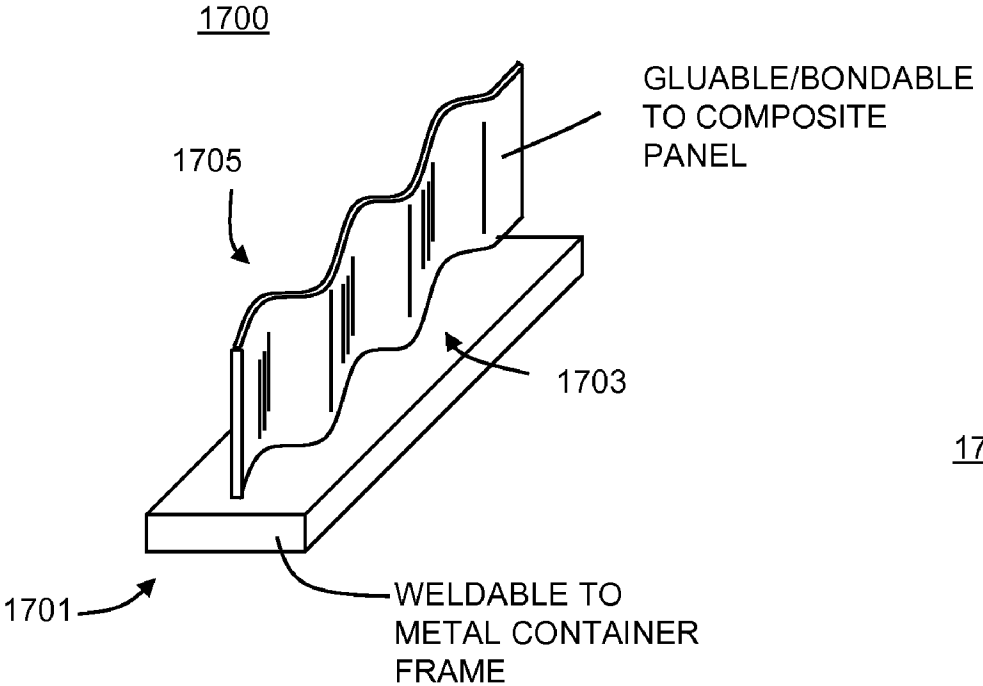

FIG. 17C shows a perspective view of another alternative embodiment of a panel frame edge 170 in which the substantially flat portion 1703 is positioned within a plane oriented at 90 degrees to a plane containing the shaped portion. An elongated edge of the shaped portion 1705 can be positioned along an elongated center line of the substantially flat portion. From an end view, the panel edge 1700 forms an "T" shape as shown. In some embodiments, a groove can be cut into the flat portion, the groove shaped to accommodate and form an interlocking engagement with an edge of the shaped portion. Each of the panel frame edges 1700 can be formed from a single piece of weldable material, such as a shaped, stamped, or cast material. Alternatively, each of the panel frame edges 1700 can be formed by more than one pieces of weldable material joined together using standard techniques, such as fasteners, bonding, welding, and interlocking engagement, such as tongue and groove. The weldable material for any of the panel frame edges 1700 can include a metal, such as steel.

FIG. 17D shows a perspective view of yet another alternative embodiment of a panel frame edge 1700 comprising an elongated flat portion 1707 that has been shaped to contour corrugations of an edge of a corrugated composite panel. The frame edge is made of a weldable material, such as steel that can be welded to the metal container frame. An edge of the composite panel can be glued to at least one side 1709 of the shaped surface, forming an intimate contact along substantially the entire edge.

Figure 18:
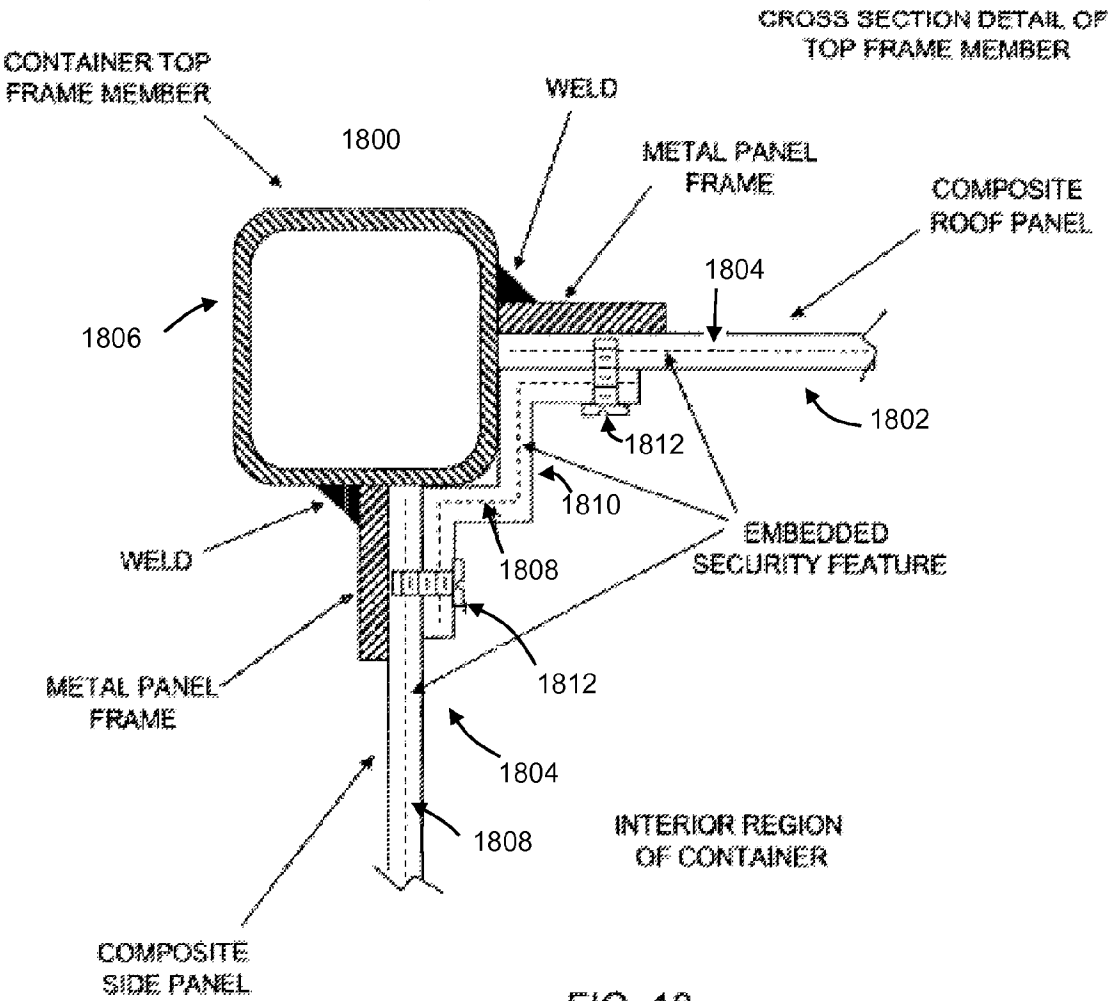
FIG. 18 shows in detail an end view of a portion of a top composite panel/frame and a side composite panel/frame, each welded to a container frame member.

FIG. 18 shows in more detail an end view of a portion of a corner joint 1800 top composite panel/frame 1802 and a side composite panel/frame 1804, each welded to a support member 1806 (e.g. a container frame member) according to the present invention. Each composite panel includes an embedded security feature 1808 illustrated as a dashed line embedded within the panel, when viewed along an edge of the panel. An angled (e.g., "L" shaped) composite corner or edge member 1810 is positioned along an adjacent container frame member, thereby covering any surface of the frame that may otherwise be exposed when adjacent panels are welded to the frame. Preferably, the composite edge member 1810 also overlaps elongated edges of the two composite panels 1802 and 1804 joined to the frame member. Such overlap ensures coverage and can facilitate coupling of the embedded security features of either of composite panel 1802 and 1804 and the composite edge member 1810.

One or more connectors 1812 can be provided to couple the embedded security feature of the composite edge member to one or more of the adjacent composite panels. As shown, data connectors 1812 are electrically conducting fasteners, such as screws. More generally, the connectors can include one or more fasteners, such as pins, nails, and staples, or connectors. Alternatively or in addition, coupling between embedded security features of one or more adjacent composite panels and/or edge members uses a wireless link. The wireless link can include inductive coupling arrangement using transformers, and radio frequency arrangement through coupled antennas. In some embodiments, wireless coupling can be accomplished using electrical circuit components at least partially buried within the composite panel and composite edge member. Such embedded components can include transformers, antennas, and optical transmitters/receivers.

Figure 19A:
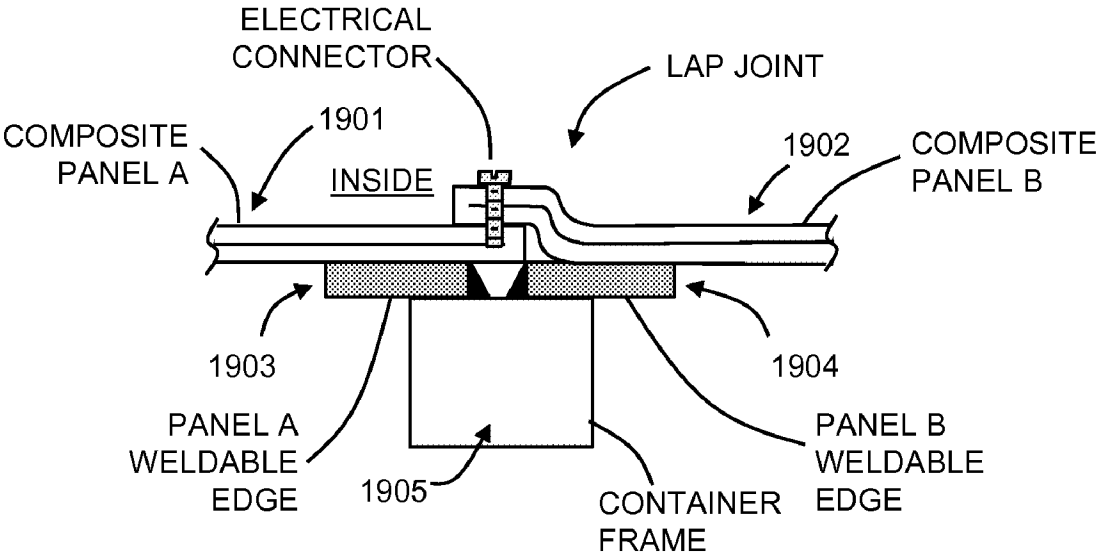
FIG. 19A and FIG. 19B show a top views of a respective portion of two side composite panel/frame members.
Figure 19B:
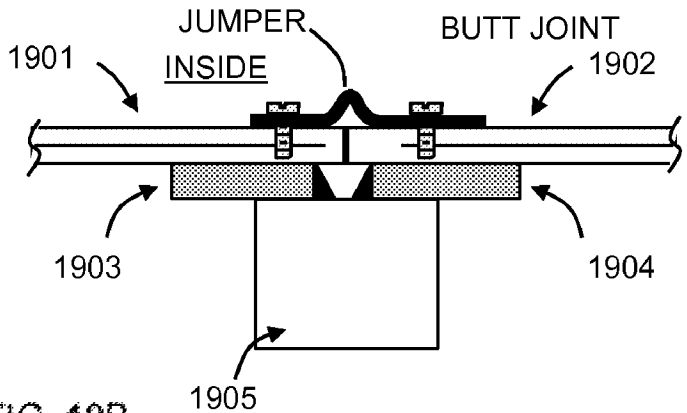

FIG. 19A and FIG. 19B show a top view of a respective portion of two side composite panel/frame members 1901 and 1902 according to the present invention. FIG. 19A features a lap joint configurations, while FIG. 19B features a butt joint configuration. As shown, frames 1903 and 1904 are welded to support member 1905 (e.g. a container frame member). Any of the approaches described herein can be used to couple embedded security features of adjoining composite members of any of the configurations. In yet further embodiments, other joint types may be used, including a mitered joint or a dado.

Figure 20:
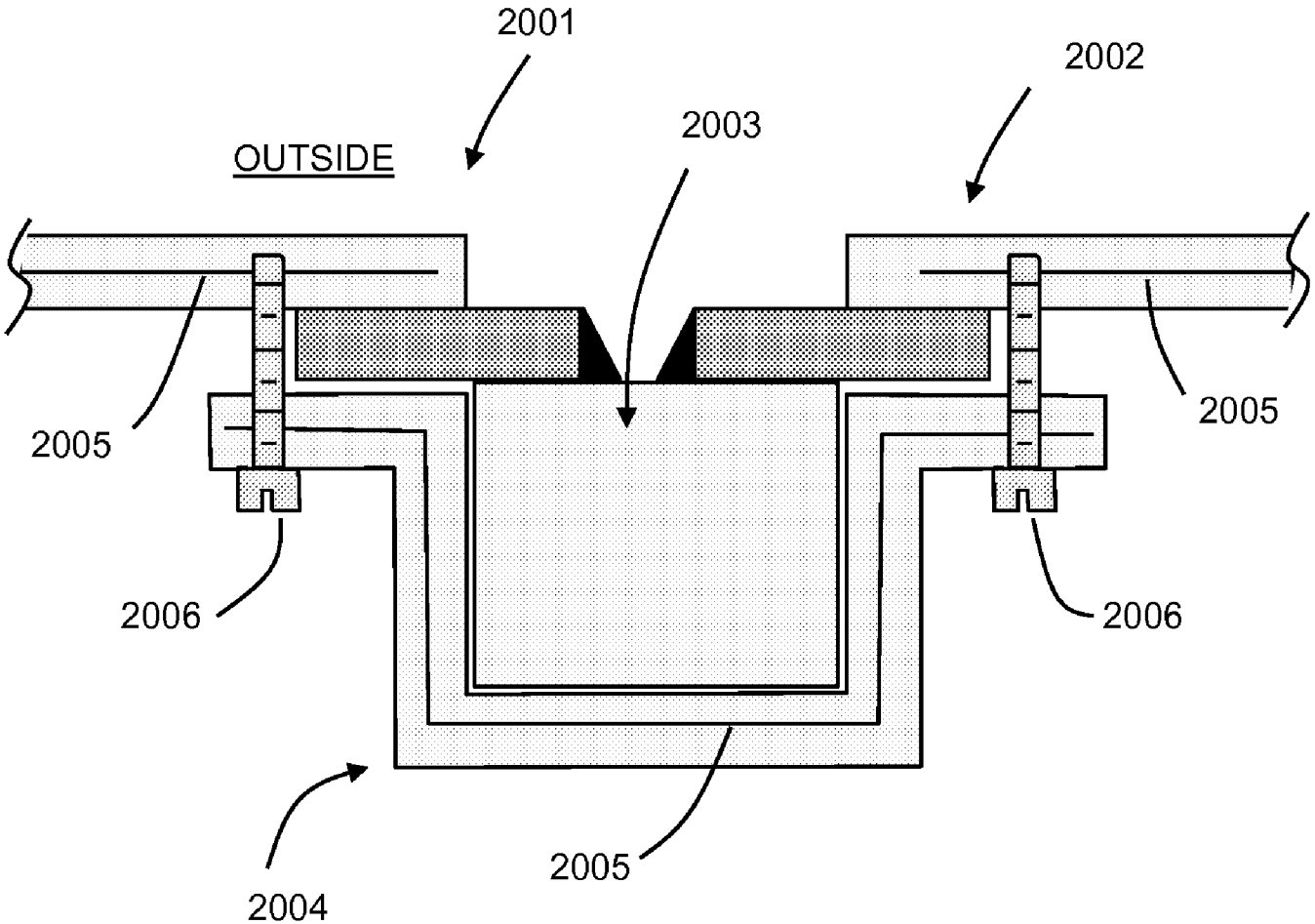
FIG. 20 shows a top view of a respective portion of two side composite panel/frame members of an alternative embodiment.

FIG. 20 shows a top view of a respective portion of two side composite panel/frame members 2001 and 2002 of an alternative embodiment according to the present invention. In the exemplary embodiment the one or more side panels are welded along either an outside or an inside surface of the container frame 2003, a composite frame covering member 2004 is provided along the same side or along an opposite side of the frame 2003 as the composite panels 2001 and 2002. In the illustrative embodiment, the panels 2001 and 2002 are positioned along an outer surface of the container frame 2003; whereas, the composite frame covering member 2004 is provided along an inner surface of the container frame. The composite frame covering member 2004 includes an embedded security feature 2005 coupled via connections 2006 to embedded security features 2005 in one or more of the adjacent composite panels 2001 and 2002 to form a security barrier along the composite panels and across the joint formed at the container frame member. Once again, any of the approaches described herein can be used to couple embedded security features of adjoining composite members of any of the configurations.

Figure 21:
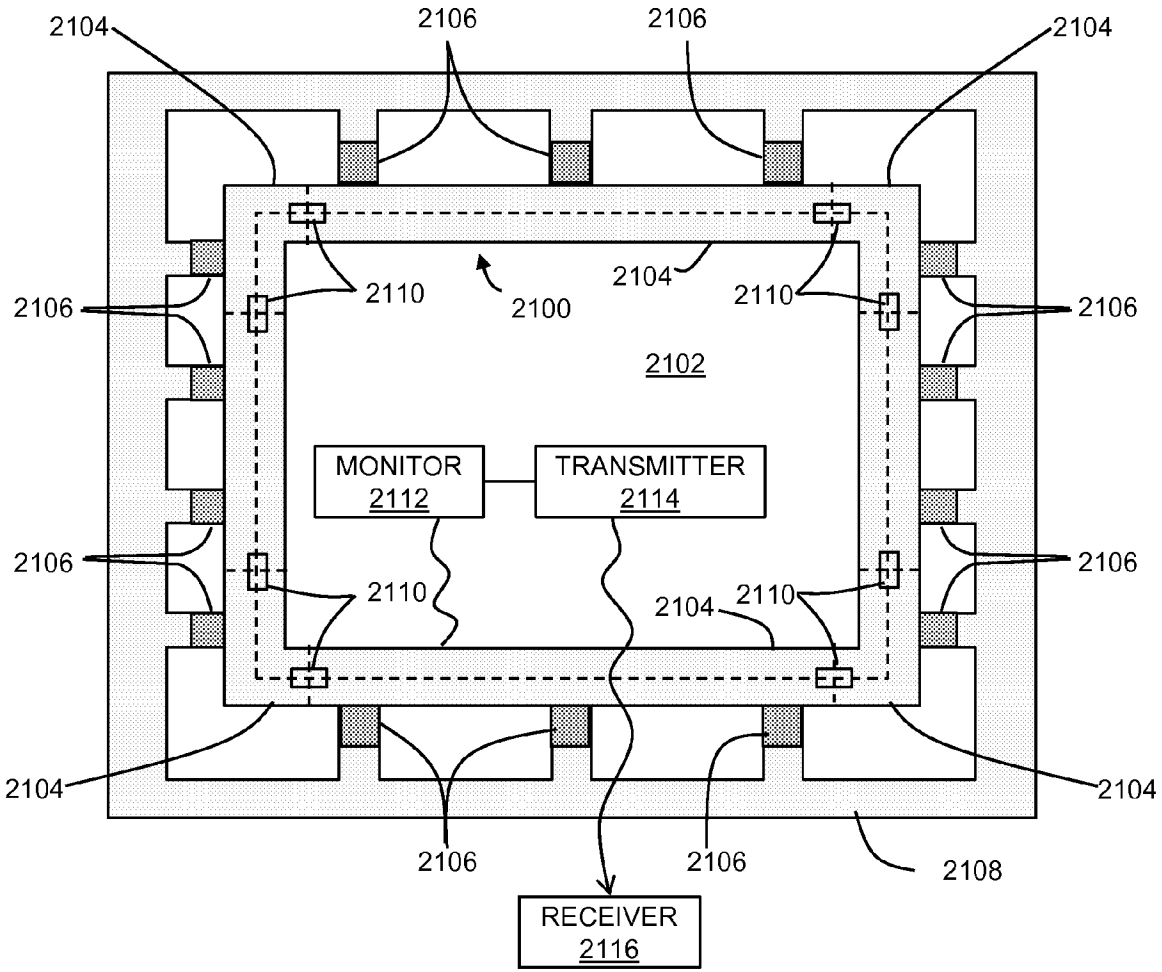
FIG. 21 shows a cross section of a container featuring a secured enclosure.

FIG. 21 shows a cross section of a substantially contiguous composite material enclosure 2100 which surrounds volume 2102. Enclosure 2100 is formed from composite panels 2104 (as shown, including corner pieces) attached to weldable frames 2106 which have been welded to the frame of container 2108. Composite panels 2104 include security elements (indicated a dashed lines) connected via connections 2110. The security elements are arranged so as to detect and substantial breach of enclosure 2100. For example, depending on the application at hand, the security elements can detect any breach at any location on enclosure 2100 having a characteristic size greater than 1 mm, 1 cm, 10 cm, 1 m, or 10 m, etc.

Enclosure 2100 may include monitor 2112 which is in communication with the security elements to monitor for any substantial breach of enclosure 2100. In some embodiments, monitor 2112 may include various energizers or detectors which work in concert with the security elements. Monitor 2112 may also be coupled to transmitter 2114, which may communicate (e.g. via a radio broadcast, modulated directed energy beam, wireless connection, RFID, etc.) with receiver 2116. Accordingly, receiver 2116 can be alerted to the detection of any substantial breach of enclosure 2100.

Figure 22:
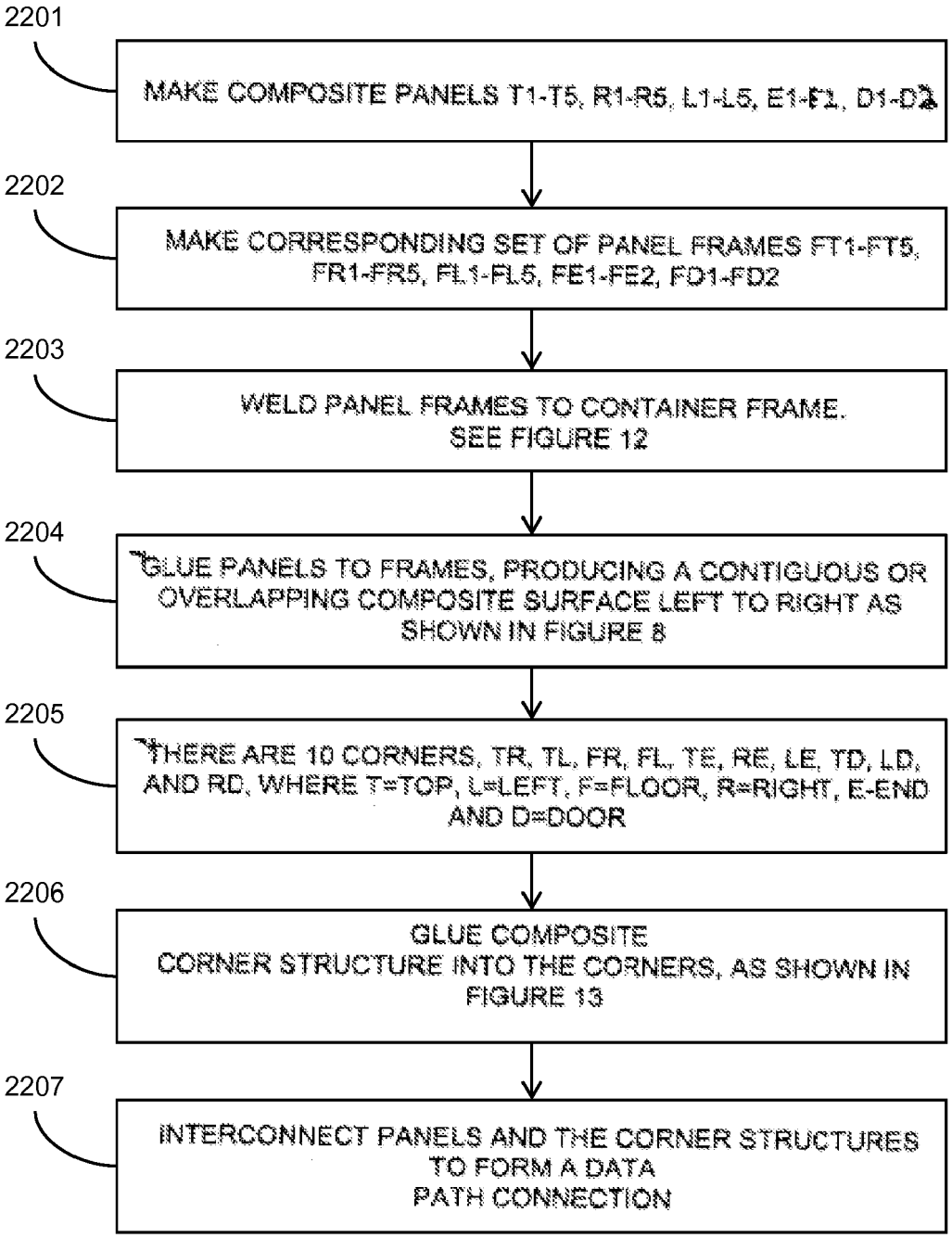
FIG. 22 illustrates a method of constructing a container featuring a secured enclosure.

Referring to FIG. 22, in some embodiments a substantially contiguous enclosure of the type described above may be constructed using the illustrated method. In step 2201, one makes composite panels e.g. panels T1-T5, L1-L5, R1-R5, E1-E2, and D1-D2 in the examples above. In step 2202 weldable panel frames are constructed corresponding to each composite panel. In step 2203, the weldable panels are welded to the interior of a container frame. In step 2204, the composite panels are affixed (e.g. by a chemical process, such as gluing) to their corresponding frames, thereby forming a contiguous composite enclosure. In step 2205, the resulting composite enclosure structure has 10 corners. In step 2206, composite corner structures are glued to the corners, e.g., as shown in FIG. 13. In step 2207, security elements embedded in the composite panels and corner structures forming the enclosure are interconnected to form a path connection capable of detecting a breach of the enclosure.

Any of the functions described above in connection breach detection monitoring, communication, automated construction, data analysis, etc. can be implemented in hardware or software, or a combination of both. The methods can be implemented in computer programs using standard programming techniques following the method and figures described herein. Program code is applied to input data to perform the functions described herein and generate output information. The output information is applied to one or more output devices such as a display monitor, memory, etc. Each program may be implemented in a high level procedural or object oriented programming language to communicate with a computer system. However, the programs can be implemented in assembly or machine language, if desired. In any case, the language can be a compiled or interpreted language. Moreover, the program can run on dedicated integrated circuits preprogrammed for that purpose.

Each such computer program is preferably stored on a storage medium or device (e.g., ROM or magnetic diskette) readable by a general or special purpose programmable computer, for configuring and operating the computer when the storage media or device is read by the computer to perform the procedures described herein. The computer program can also reside in cache or main memory during program execution. The analysis method can also be implemented as a computer-readable storage medium, configured with a computer program, where the storage medium so configured causes a computer to operate in a specific and predefined manner to perform the functions described herein.

A number of examples above describe surfaces or enclosures of substantially contiguous composite material. As will be understood by those skilled in the art, depending on the application, some small gaps in such surfaces may be permissible. For example, in some embodiments, a substantially contiguous composite surface or enclosure may have gaps or apertures having a characteristic size of 0.01 mm or less, 0.0.1 mm or less, 1 mm or less, 10 mm or less, or 100 mm or less. In various embodiments, the acceptable gap size will depend on considerations such as the sensitivity of the cargo being protected, the size of the container, cost issues, etc.

A number of documents have been incorporated by reference herein. In the event that any material, e.g. a technical definition, found in the incorporated documents conflicts with that found in the instant text, the material in instant text holds.

While this invention has been particularly shown and described with references to preferred embodiments thereof, it will be understood by those skilled in the art that various changes in form and details may be made therein without departing from the scope of the invention encompassed by the appended claims.

For example, although the above examples describe the use of composite materials, it will be understood that the techniques described herein may be applied to security structures featuring other types of materials not suitable for welding (e.g. plastics, wood, non-reinforced resins, ceramics, epoxies, etc.). Such materials may include embedded security elements, as described above.

What is claimed is:

1. An apparatus comprising:

a weldable frame;

a plurality of composite panels, each composite panel securable to the weldable frame, each composite panel configured to form at least one joint with at least one adjoining composite panel, and a respective security element embedded within each of the composite panels, wherein the security element is configured to detect a breach in the composite panel, wherein a first and a second of the security element embedded, respectively, within a first and a second of the plurality of composite panels are interconnected such that the first security element can detect a breach in the second composite panel;

said apparatus further comprising a corner joint, wherein, at said corner joint, at least a portion of the weldable frame of each of a first and a second security structures are welded to each other or to a weldable support member, and at least a portion of a composite panel from the first security structure and at least a portion of a composite panel from the second security structure form an angled joint of substantially contiguous composite material.

2. The apparatus of claim 1, wherein the corner joint comprises an interconnect between security elements embedded in the first and the second security structures.

3. The apparatus of claim 1, wherein the plurality of security structures form an enclosure surrounding a volume with substantially contiguous composite material.

4. The apparatus of claim 3, wherein the enclosure is substantially free of gaps in the contiguous composite material, and comprises a plurality of interconnected security elements configured to detect any substantial breach of the enclosure.

5. The apparatus of claim 4, further comprising a monitor in communication with the plurality of interconnected security elements and configured to monitor for any substantial breach of the enclosure.

6. The apparatus of claim 5, wherein the monitor unit is located within the enclosure, and further comprising a transmitter configured to transmit a signal indicative of a detection of a substantial breach of the enclosure to a receiver located outside of the enclosure.

7. The apparatus of claim 4, further comprising a weldable container frame and wherein at least one weldable frame of the one or more security structures is welded to the container frame.

8. The apparatus of claim 7, further comprising a metal shipping container, said shipping container surrounding the enclosure and comprising at least a portion of the weldable container frame.

9. The apparatus of claim 1, wherein the security element comprises a conductive element or a waveguide.

10. The apparatus of claim 3, further comprising an elongated composite member including a security element, the elongated composite member configured to cover a gap between adjacent composite panels forming the enclosure.

11. The apparatus of claim 3, wherein the at least one joint comprises at least one chosen from the list consisting of: a butt joint, a lap joint, a mitered joint, a dado.

12. The apparatus of claim 1, wherein the security element comprises a conductive element or a waveguide.

13. The apparatus of claim 1, wherein each composite panel of the plurality of composite panels is fastened to the frame using at least one chosen from the group consisting of: a chemical fastener, glue, epoxy, cement.

14. A method comprising assembling a first and second security structure by, for each security structure, forming a weldable frame;

welding at least one portion of the weldable frame of the first security structure to at least one of at least a portion of the weldable frame the second security structure and a weldable support member;

aligning each panel of a plurality of composite panels to form at least one joint with at least one adjoining composite panel to form a substantially contiguous composite surface with the other panels, each of the composite panels including an embedded security element configured to detect a breach of the composite panel;

attaching each panel of the plurality of aligned composite panels to the weldable frame thereby forming a contiguous composite surface attached to the welded metal frame; and interconnecting a first and a second of the security element embedded, respectively, within a first and a second of the plurality of composite panels such that the first security element can detect a breach in the second composite panel.

15. The method of claim 14, further comprising interconnecting a plurality of the embedded security elements.

16. The method of claim 15, wherein one or more security structures comprise a plurality of security structures, and further comprising:

arranging the security structures to form an enclosure surrounding a volume with substantially contiguous composite material, wherein the enclosure:

is substantially free of gaps in the contiguous composite material, and comprises a plurality of interconnected security elements configured to detect any substantial breach of the enclosure.

17. The method of claim 16, further comprising monitoring for a detected breach of the enclosure.

18. An apparatus comprising:

a first and a second security structure, each comprising:

a weldable frame;

a plurality of composite panels, each composite panel securable to the weldable frame, each composite panel configured to form at least one joint with at least one adjoining composite panel, and a respective security element embedded within each of the composite panels, wherein the security element is configured to detect a breach in the composite panel, wherein a first and a second of the security element embedded, respectively, within a first and a second of the plurality of composite panels are interconnected such that the first security element can detect a breach in the second composite panel;

said apparatus further comprising a joint, wherein, at said joint, at least a portion of the weldable frame of each of the first and the second security structures are welded to each other or to a weldable support member, and at least a portion of a composite panel from a first security structure and at least a portion of a composite panel from a second security structure form a joint of substantially contiguous composite material.

19. The method of claim 14, wherein the act of attaching each panel occurs after the act of welding the weldable frame.

20. An apparatus comprising:

a first and a second security structure, each comprising:

a weldable frame;

a plurality of composite panels, each composite panel securable to the weldable frame, each composite panel configured to form at least one joint with at least one adjoining composite panel, and a respective security element embedded within each of the composite panels, wherein the security element is configured to detect a breach in the composite panel, wherein a first and a second of the security element embedded, respectively, within a first and a second of the plurality of composite panels are interconnected such that the first security element can detect a breach in the second composite panel;

said apparatus further comprising a joint, wherein, at said joint, at least a portion of the weldable frame of each of the first and the second security structures are welded to each other or to a weldable support member, and at least a portion of a composite panel from a first security structure and at least a portion of a composite panel from a second security structure form a joint of substantially contiguous composite material.

* * * * *